US007951440B2

(12) United States Patent
Butler, III

(10) Patent No.: US 7,951,440 B2
(45) Date of Patent: May 31, 2011

(54) DISPENSING PAPER-ROLL CORE SYSTEMS

(75) Inventor: George H. Butler, III, Mesa, AZ (US)

(73) Assignee: The Procter & Gamble Company, Cincinnati, OH (US)

( * ) Notice: Subject to any disclaimer, the term of this patent is extended or adjusted under 35 U.S.C. 154(b) by 851 days.

(21) Appl. No.: 10/948,602

(22) Filed: Sep. 23, 2004

(65) Prior Publication Data

US 2005/0069665 A1 Mar. 31, 2005

Related U.S. Application Data

(60) Provisional application No. 60/506,050, filed on Sep. 26, 2003, provisional application No. 60/580,925, filed on Jun. 17, 2004.

(51) Int. Cl.
*B65D 65/38* (2006.01)
*B65D 65/46* (2006.01)

(52) U.S. Cl. ..... 428/36.9; 40/309; 242/159; 242/160.1; 510/109; 510/191; 510/446

(58) Field of Classification Search ..... 428/36.9, 428/35.7; 40/309; 252/522; 15/145; 242/159, 242/160.1; 510/109, 191, 446
See application file for complete search history.

(56) References Cited

U.S. PATENT DOCUMENTS

| | | | | |
|---|---|---|---|---|
| 1,126,710 A | | 2/1915 | Conry | |
| 1,761,111 A | * | 6/1930 | Doty | 106/160.1 |
| 3,194,275 A | | 7/1965 | Biggs, Jr. et al. | |
| 3,347,236 A | * | 10/1967 | Torr | 604/364 |
| 3,400,717 A | * | 9/1968 | Cubitt et al. | 604/364 |
| 3,419,005 A | | 12/1968 | Lewing | |
| 3,555,976 A | | 1/1971 | Carter et al. | |
| 3,865,271 A | | 2/1975 | Gold | |
| 3,921,802 A | * | 11/1975 | Thompson | 206/225 |
| 4,511,496 A | * | 4/1985 | Matsumoto | 512/4 |
| 4,852,201 A | * | 8/1989 | Wundrock et al. | 15/145 |
| 5,236,616 A | * | 8/1993 | Oakes et al. | 510/376 |
| 5,543,309 A | | 8/1996 | Pischel | |
| 5,578,562 A | * | 11/1996 | Lockhart | 510/446 |
| 5,865,396 A | | 2/1999 | Ogg et al. | |

(Continued)

FOREIGN PATENT DOCUMENTS

EP 0 232 141 * 1/1987

(Continued)

OTHER PUBLICATIONS

Life Science Dictionary, 1995-98, http://biotech.icmb.utexas.edu, definition of surfactant and detergent.*

*Primary Examiner* — Brent T O'Hern
(74) *Attorney, Agent, or Firm* — Andrew A Paul; Peter D. Mayer

(57) ABSTRACT

A paper-roll core that is a soluble, disposable carrier for cleaning and/or disinfecting chemicals. The paper-roll cores are toilet paper roll cores and paper towel roll cores and are rapidly soluble in water and may release cleansers, disinfectants, colors, etc., upon dissolving. Described are: methods of using, manufacturing, advertising, and distributing the paper-roll cores; and methods of advertising and distributing such paper-roll cores to children, who will particularly enjoy the novelty; and methods of modifying existing paper-roll core manufacturing equipment to manufacture soluble cleanser-dispensing paper-roll cores.

39 Claims, 16 Drawing Sheets

U.S. PATENT DOCUMENTS

| | | | | |
|---|---|---|---|---|
| 6,121,170 | A | 9/2000 | Tsai et al. | |
| 6,631,574 | B2 * | 10/2003 | Okyere | 40/309 |
| 6,713,441 | B1 * | 3/2004 | DeSenna et al. | 510/191 |
| 6,743,361 | B1 * | 6/2004 | Doege et al. | 210/605 |
| 2003/0132330 | A1 | 7/2003 | Kubota et al. | |
| 2003/0191043 | A1 * | 10/2003 | Becker et al. | 510/392 |
| 2004/0120990 | A1 * | 6/2004 | Cushman et al. | 424/443 |

FOREIGN PATENT DOCUMENTS

| | | | |
|---|---|---|---|
| GB | 2276548 | * | 10/1994 |
| GB | 2202750 | A | 10/1998 |
| GB | 2401870 | A | 11/2004 |
| JP | 09118478 | A2 | 5/1997 |
| WO | WO 99/02083 | * | 1/1999 |
| WO | WO 00/44982 | A1 | 8/2000 |
| WO | WO 02/47998 | A1 | 6/2002 |

* cited by examiner

DISPENSING PAPER-ROLL CORE SYSTEMS

CROSS-REFERENCE TO RELATED APPLICATION

The present application is related to prior provisional application Ser. No. 60/506,050, filed Sep. 26, 2003, entitled "DISSOLVABLE TOILET PAPER TUBE USED TO DEODORIZE AND SANITIZE THE TOILET"; and to prior provisional application Ser. No. 60/580,925, filed Jun. 17, 2004, entitled "DISPENSING PAPER-ROLL CORE SYSTEMS", the contents of which are incorporated herein by these references and are not admitted to be prior art with respect to the present invention by their mention in this cross-reference section.

BACKGROUND

This invention relates to dispensing paper-roll core systems. More particularly, it relates to paper-roll cores that are water-soluble and release cleansers into water.

Typically, paper-roll cores, such as toilet paper-roll cores, paper towel roll cores, etc., are cardboard tubes that are thrown away or recycled after use. They are not flushable.

Typically, toilet bowls (and garbage disposals, to a lesser extent) require frequent cleaning to maintain a sanitary condition. Toilet bowls are typically cleaned with liquid or powdered cleaning products, or with cleansing tablets that slowly dissolve in the toilet tank. Unfortunately, toilets are not sanitized as often as may be preferable, because the required cleansers are not readily at hand at frequent intervals. Many households do not use dissolving tablets because of the risk of poisoning to pets and very young children.

Therefore, a need exists for a convenient way to sanitize the toilet bowl at frequent intervals. Further, a need exists for a non-toxic bowl sanitizing system. Even further, a need exists to increase the usefulness of paper-roll cores.

OBJECTS AND FEATURES OF THE INVENTION

A primary object and feature of the present invention is to overcome the above-mentioned problems and fulfill the above-mentioned needs.

Another object and feature of the present invention is to provide a paper-roll core that is a soluble, disposable carrier for cleaning and/or disinfecting chemicals.

Yet a further object and feature of the present invention is to provide methods of distributing such paper-roll cores to children, who will particularly enjoy the novelty.

It is yet a further object and feature of the present invention to provide methods of modifying existing paper-roll core manufacturing equipment to manufacture soluble cleanser-dispensing paper-roll cores.

Another object and feature of the present invention is to provide for such paper-roll cores to carry one or more additional chemicals helpful in use by, entertainment of, or marketing to users of such paper-roll cores.

It is an additional primary object and feature of the present invention to provide such a system that is efficient, inexpensive and handy. Other objects and features of this invention will become apparent with reference to the following descriptions.

SUMMARY OF THE INVENTION

In accordance with a preferred embodiment hereof, this invention provides a core system, relating to dispensing roll(s) of paper, comprising: soluble paper-roll core means for solubly coring at least one such roll of paper; and cleanser means for cleaning at least one plumbing fixture; wherein such soluble paper-roll core means comprises such cleanser means. Moreover, it provides such a core system, wherein such soluble paper-roll core means comprises unitary bulk means for providing bulk unitary material for such soluble paper-roll core means. Additionally, it provides such a core system, wherein such soluble paper-roll core means comprises plastic means for providing plastic material for such soluble paper-roll core means. Also, it provides such a core system, further comprising: paper roll means for providing at least one such roll of paper; and connector means for connecting such paper roll means about such soluble paper-roll core means. In addition, it provides such a core system, wherein such soluble paper-roll core means comprises layer means for providing layering of such soluble paper-roll core means.

In accordance with another preferred embodiment hereof, this invention provides a core system, relating to dispensing roll(s) of paper, comprising: at least one soluble paper-roll core adapted to solubly core at least one paper-roll; and at least one cleanser adapted to clean at least one plumbing fixture wherein such at least one soluble paper-roll core comprises such at least one cleanser. And, it provides such a core system, wherein such at least one soluble paper-roll comprises at least one toilet paper-roll. Further, it provides such a core system, wherein such at least one soluble paper-roll comprises at least one paper towel roll. Even further, it provides such a core system, wherein such at least one soluble paper-roll core comprises at least one unitary bulk adapted to provide at least one bulk unitary material for such at least one soluble paper-roll core. Moreover, it provides such a core system, wherein such at least one soluble paper-roll core comprises at least one layer adapted to provide at least one layering of such at least one soluble paper-roll core. Additionally, it provides such a core system, wherein such at least one layer comprises a plurality of layers adapted to provide a plurality of layers of at least one water-soluble material. Also, it provides such a core system, wherein such at least one soluble paper-roll core comprises at least one plastic adapted to provide at least one plastic material for such at least one soluble paper-roll core.

In addition, it provides such a core system, further comprising: at least one paper roll adapted to provide at least one such roll of paper; and at least one connector adapted to connect such at least one paper roll about such at least one soluble paper-roll core. And, it provides such a core system, wherein such at least one connector is water-soluble. Further, it provides such a core system, wherein such at least one connector comprises at least one color additive adapted to provide at least one color to water upon dissolving. Even further, it provides such a core system, wherein such at least one connector comprises at least one cleanser adapted to provide at least one cleanser to water upon dissolving. Moreover, it provides such a core system, wherein such at least one connector comprises at least one disinfectant additive adapted to provide at least one disinfectant to water upon dissolving. Additionally, it provides such a core system, wherein such at least one soluble paper-roll core comprises at least one cleanser adapted to provide at least one cleanser to water upon dissolving.

Also, it provides such a core system, wherein such at least one cleanser comprises at least one detergent adapted to dissolve organic debris. In addition, it provides such a core system, wherein such at least one cleanser comprises at least one surfactant adapted to dislodge organic debris from such at least one plumbing fixture. And, it provides such a core system, wherein such at least one soluble paper-roll core comprises at least one disinfectant adapted to provide at least one disinfectant to water upon dissolving. Further, it provides such a core system, wherein such at least one soluble paper-roll core comprises at least one water-soluble coating layer adapted to provide at least one water-soluble coating material layer. Even further, it provides such a core system, wherein such at least one soluble paper-roll core comprises at least one acid adapted to provide at least one acid to water upon dissolving. Moreover, it provides such a core system, wherein such at least one soluble paper-roll core comprises at least one base adapted to provide at least one base to water upon dissolving. Additionally, it provides such a core system, wherein such at least one soluble paper-roll core comprises at least one color additive adapted to provide at least one color to water upon dissolving.

Also, it provides such a core system, wherein such at least one soluble paper-roll core comprises at least one binder to bind the ingredients of such at least one soluble paper-roll core together. In addition, it provides such a core system, wherein such at least one binder comprises at least one sugar. And, it provides such a core system, wherein such at least one binder comprises polyethylene glycol. Further, it provides such a core system, wherein such at least one binder comprises sorbitol. Even further, it provides such a core system, wherein such at least one binder comprises maltodextrin. Moreover, it provides such a core system, wherein such at least one binder comprises at least one pectin.

Additionally, it provides such a core system, wherein such at least one soluble paper-roll core comprises at least one lubricant to lubricate the ingredients of such at least one soluble paper-roll core during manufacturing processes. Also, it provides such a core system, wherein such at least one lubricant comprises sodium benzoate. In addition, it provides such a core system, wherein such at least one lubricant comprises at least one stearate. And, it provides such a core system, wherein such at least one lubricant comprises polyethylene glycol. Further, it provides such a core system, wherein such at least one lubricant comprises at least one mineral oil. Even further, it provides such a core system, wherein such at least one lubricant comprises at least one silicate. Moreover, it provides such a core system, wherein such at least one lubricant comprises algenic acid.

Additionally, it provides such a core system, such at least one soluble paper-roll core further comprising at least one gas-releaser adapted to release gas into at least one quantity of water contained in such at least one plumbing fixture. Also, it provides such a core system, wherein such at least one gas-releaser comprises at least one alkali carbonate. In addition, it provides such a core system, wherein such at least one gas-releaser comprises at least one acid. And, it provides such a core system, wherein such at least one gas-releaser comprises at least one gas. Further, it provides such a core system, such at least one soluble paper-roll core further comprising at least one instructional indicia adapted to visually instruct at least one user. Even further, it provides such a core system, such at least one soluble paper-roll core further comprising at least one entertainment indicia adapted to visually entertain at least one user.

In accordance with another preferred embodiment hereof, this invention provides a method, relating to at least one soluble dispensing paper-roll core having cleansing properties, comprising the steps of: acquiring at least one paper-roll having at least one cleanser-releasing soluble core; removing substantially all paper from such at least one paper-roll; placing such at least one cleanser-releasing soluble core in at least one plumbing fixture; and wetting such at least one cleanser-releasing soluble core. Moreover, it provides such a method, wherein such at least one plumbing fixture comprises at least one toilet bowl. Additionally, it provides such a method, wherein such at least one plumbing fixture comprises at least one garbage disposal.

In accordance with another preferred embodiment hereof, this invention provides a method, relating to at least one soluble dispensing paper-roll core having cleansing properties, comprising the steps of: offering for sale at least one paper-roll having at least one cleanser-releasing soluble core; and advertising the availability of such at least one paper-roll having such at least one cleanser-releasing soluble core to at least one demographic; wherein such at least one demographic substantially comprises persons between about two and about ten years of age.

In accordance with another preferred embodiment hereof, this invention provides a method, relating to at least one soluble dispensing paper-roll core having cleansing properties, comprising the steps of: analyzing at least one paper-roll core manufacturing machine; and modifying at least one paper-roll core manufacturing machine to incorporate at least one cleanser into such at least one paper-roll core wherein such steps of analyzing and modifying are adapted to be commercially advantageous over the cost of replacing such at least one paper-roll core manufacturing machine. Also, it provides such a method, further comprising the step of modifying at least one paper-roll core manufacturing machine to incorporate at least one disinfectant into such at least one paper-roll core. In addition, it provides such a method, further comprising the step of modifying at least one paper-roll core manufacturing machine to incorporate at least one soluble color into such at least one paper-roll core. And, it provides such a method, further comprising the step of modifying at least one paper-roll core manufacturing machine to incorporate at least one gas-releasing material into such at least one paper-roll core.

In accordance with another preferred embodiment hereof, this invention provides a method, relating to at least one soluble dispensing paper-roll core having cleansing properties, comprising the steps of: manufacturing flexible strips of water-soluble material; applying at least one cleanser material to at least one portion of such flexible strips of water-soluble material; winding such flexible strips of water-soluble material onto a mandrel; and adhering such flexible strips of water-soluble material together to form a tube. Further, it provides such a method, further comprising the step of applying at least one chemical treatment to such flexible strips of water-soluble material.

In accordance with another preferred embodiment hereof, this invention provides a method, relating to at least one soluble dispensing paper-roll core having cleansing properties, comprising the steps of: selecting at least one water-soluble material; selecting at least one cleanser material; adding such at least one cleanser material to at least one liquid batch of such at least one water-soluble material; and extruding at least one tube from such at least one liquid batch. Even further, it provides such a method, further comprising the steps of: selecting at least one solvent that is a chemically inert solvent of such at least one cleanser and such at least one water-soluble material; and adding such at least one solvent to at least one liquid batch of such at least one water-soluble material. Even further, it provides such a method, wherein the step of selecting at least one solvent comprises the step of selecting at least one alcohol that is a chemically inert solvent of such at least one cleanser and such at least one water-soluble material.

In accordance with another preferred embodiment hereof, this invention provides a method, relating to at least one soluble dispensing paper-roll core having cleansing properties, comprising the steps of: formulating at least one powder comprising at least one cleanser; and compressing such at least one powder into the shape of at least one paper-roll core.

In accordance with another preferred embodiment hereof, this invention provides a method, relating to at least one soluble dispensing paper-roll core having cleansing properties, comprising the steps of: formulating at least one powder comprising layered microspheres comprising at least one cleanser; and compressing such at least one powder into the shape of at least one paper-roll core.

In accordance with another preferred embodiment hereof, this invention provides a method, relating to at least one soluble dispensing paper-roll core having cleansing properties, comprising the steps of: mixing at least one sugar, at least one thickener, at least one cleanser, and at least one solvent into at least one liquid batch; heating such at least one liquid batch to activate such at least one thickener and drive off such at least one solvent; dispensing such at least one liquid batch between at least two layers of at least one water-soluble material; simultaneously heating such at least two layers of at least one water-soluble material containing such at least one liquid batch, and rolling such at least two layers of at least one water-soluble material containing such at least one liquid batch between at least two rollers; and winding such at least two layers of at least one water-soluble material containing such at least one liquid batch onto at least one mandrel to form at least one tube.

DETAILED DESCRIPTION OF THE BEST MODES AND PREFERRED EMBODIMENTS OF THE INVENTION

Figure 1:
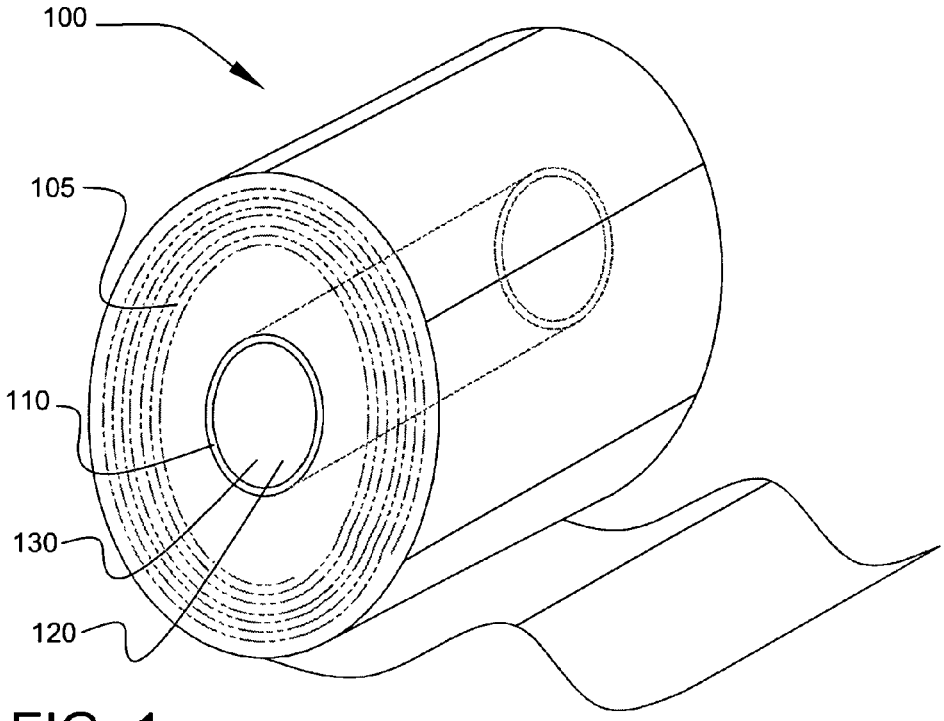
FIG. 1 shows a perspective view illustrating a dispensing paper-roll core system according to a preferred embodiment of the present invention.

FIG. 1 shows a perspective view illustrating a dispensing paper-roll core system 100 according to a preferred embodiment of the present invention. Preferably, dispensing paper-roll core system 100 comprises paper roll 105 and dispensing core 110, as shown. Preferably, paper roll 105 comprises a roll of disposable paper products, such as, for example, toilet tissue, paper towels, shop towels, etc. Most preferably, paper roll 105 comprises toilet tissue, as shown. Preferably, dispensing core 110 comprises a hollow, preferably circular, support core around which paper roll 105 is wound, as shown. Preferably, dispensing core 110 (at least embodying herein wherein such soluble paper-roll core means comprises such cleanser means) is water-soluble and contains cleaning ingredients 120 that are released into the water 951 when dispensing core 110 dissolves, as shown. Upon reading the teachings of this specification, those of ordinary skill in the art will now understand that, under appropriate circumstances, such as user preference, advances in technology, intended use, etc., other dispensing core features, such as different shapes, additional ingredients, other types of rolls of material, cores having multiple separable parts, etc., may suffice.

Preferably, dispensing core 110 comprises a rapidly-dissolving water-soluble support material 130, as shown, such as, for example, Dissolvo™ paper (manufactured by Gilbreth Packaging Systems of Croydon, Pa., USA), polyvinyl alcohol polymers, starch, gelatin, etc. Upon reading the teachings of this specification, those of ordinary skill in the art will now understand that, under appropriate circumstances, such as user preference, advances in technology, intended use, etc., other water-soluble materials, such as ion-sensitive soluble plastics, starch-based plastics, composite materials, etc., may suffice.

Preferably, after paper roll 105 (at least embodying herein at least one paper roll adapted to provide at least one such roll of paper) has been used up, dispensing core 110 may be placed in a wet plumbing fixture, as shown, to clean and disinfect the plumbing fixture. For example, most preferably, where paper roll 105 (at least embodying herein wherein such at least one paper-roll comprises at least one toilet paper-roll) comprises toilet tissue, dispensing core 110 (at least embodying herein soluble paper-roll core means for solubly coring at least one such roll of paper) is disposed of by placing it in a toilet bowl 950 containing water, where it rapidly dissolves, releasing cleaning ingredients 120 (at least embodying herein cleanser means for cleaning at least one plumbing fixture), as shown, which then clean and disinfect the toilet bowl 950. In a further preferred example, where paper roll 105 (at least embodying herein wherein such at least one paper-roll comprises at least one paper towel roll) comprises paper towels, dispensing core 110 (at least embodying herein at least one soluble paper-roll core adapted to solubly core at least one paper-roll) is disposed of by washing it down a garbage disposal 1100 or sink, as shown, in which case it rapidly dissolves, releasing cleaning ingredients 120 (at least embodying herein at least one cleanser adapted to clean at least one plumbing fixture) into the garbage disposal 1100 and/or sink pipes. Upon reading the teachings of this specification, those of ordinary skill in the art will now understand that, under appropriate circumstances, such as user preference, advances in technology, intended use, etc., other plumbing fixtures, such as drains, dishwashers, etc., may suffice.

Typically, the end of the paper roll 105 (at least embodying herein paper roll means for providing at least one such roll of paper) is connected to the dispensing core 110, preferably with glue 211 (at least embodying herein connector means for connecting such paper roll means about such soluble paper-roll core means, and at least embodying herein at least one connector adapted to connect such at least one paper roll about such at least one soluble paper-roll core, and at least embodying herein wherein said at least one connector is water-soluble), which is preferably water-soluble. Preferably, glue 211 comprises colorant 148 and/or chemical ingredients 120 (particularly disinfectant 146) for release into water, as shown and further described in FIG. 2. Upon reading the teachings of this specification, those with ordinary skill in the art will now understand that, under appropriate circumstances, considering such issues as advances in technology, user preference, chemical compatibility, etc., other connectors, such as embossing the end of the paper onto the core, other connector ingredients, etc., may suffice.

Figure 2:
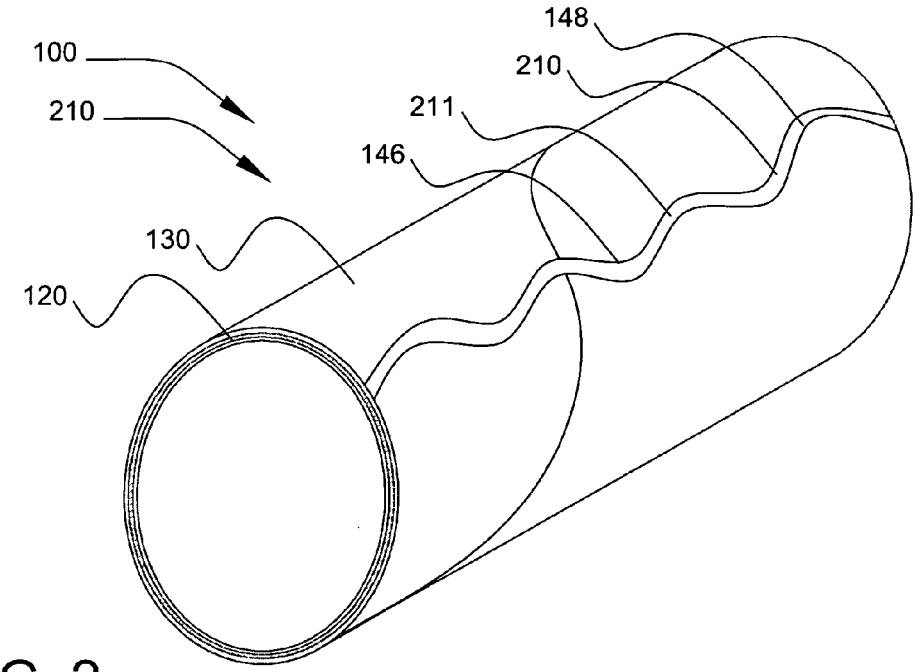
FIG. 2 shows a perspective view of a layered dispensing core containing chemical layers according to a preferred embodiment of the present invention.

FIG. 2 is a perspective view of a layered dispensing core 210 containing layers of chemical ingredients 120 according to a preferred embodiment of the present invention. Preferably, dispensing core 110 comprises layered dispensing core 210, as shown. Preferably, cleaning ingredients 120 (at least embodying herein wherein such at least one soluble paper-roll core comprises such at least one cleanser) and water-soluble material 130 (at least embodying herein wherein such at least one layer comprises a plurality of layers adapted to provide a plurality of layers each of at least one water-soluble material) are layered together, as shown, preferably during a spiral-winding manufacturing process, to make layered dispensing core 210 (at least embodying herein wherein such soluble paper-roll core means comprises layer means for providing layering of such soluble paper-roll core means). Upon reading the teachings of this specification, those of ordinary skill in the art will now understand that, under appropriate circumstances, such as user preference, advances in technology, intended use, etc., other manufacturing processes, such as surface coating the finished tube, etc., may suffice.

Figure 3:
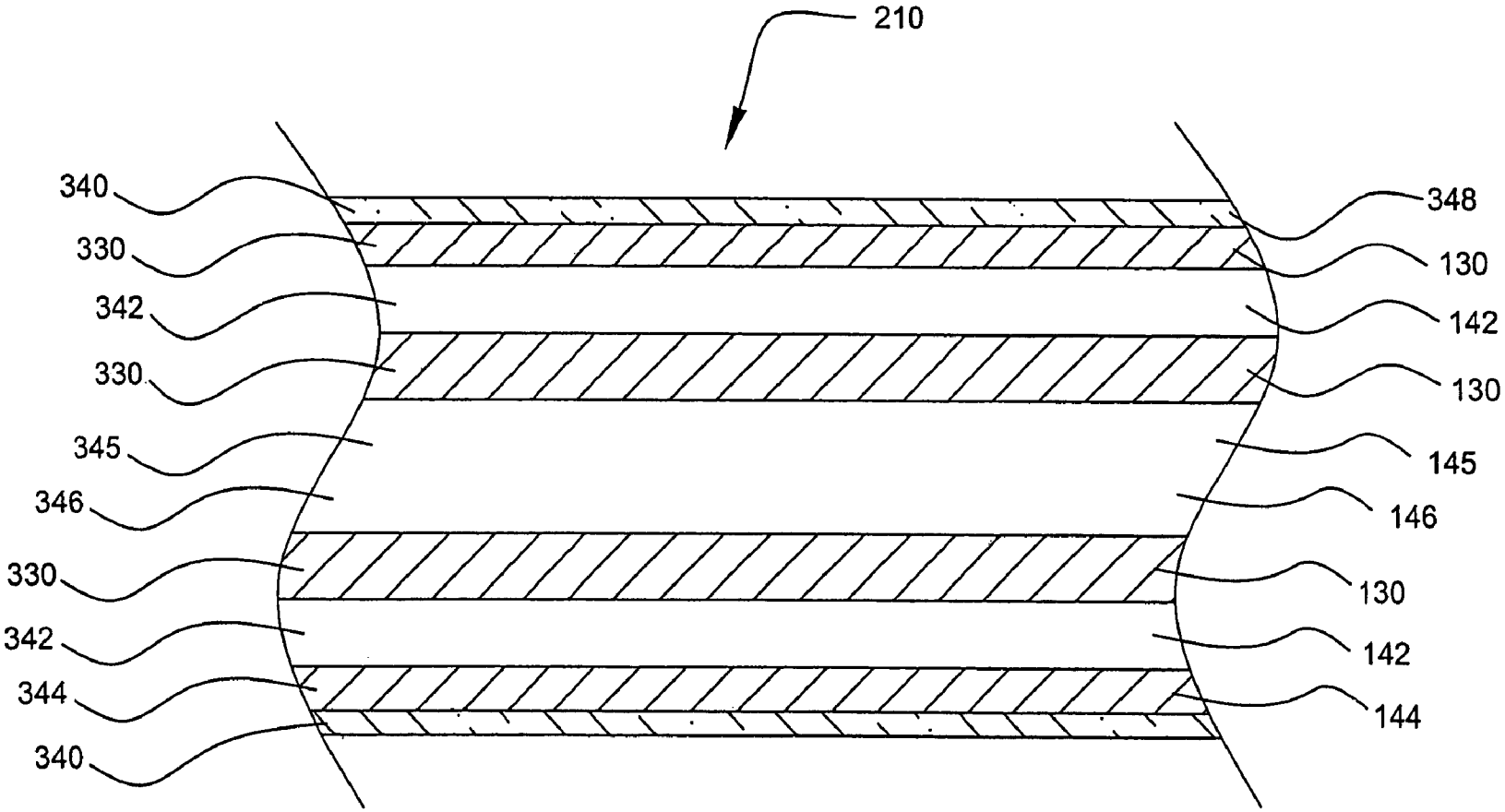
FIG. 3 shows a cross-sectional view of the paper-roll core according to FIG. 2.

FIG. 3 is a cross-sectional view of the dispensing core 210 according to FIG. 2. Preferably, cleaning ingredients 120 at least comprise at least one of an acid 142, a base 144, a cleanser 145, and/or a disinfectant 146, as shown. Preferably, layered dispensing core 210 (at least embodying herein wherein such at least one soluble paper-roll core comprises at least one layer adapted to provide at least one layering of such at least one soluble paper-roll core) comprises water-soluble material layer 330, coating 340, acid layer 342 (at least embodying herein wherein such at least one layer comprises at least one acid layer adapted to provide at least one acid material layer) having acid 142, base layer 344 (at least embodying herein wherein such at least one layer comprises at least one basic layer adapted to provide at least one basic material layer) having base 144, cleanser layer 345 (at least embodying herein wherein such at least one layer comprises at least one cleanser layer adapted to provide at least one cleanser material layer) having cleanser 145, and disinfectant layer 346 (at least embodying herein wherein such at least one layer comprises at least one disinfectant layer adapted to provide at least one disinfectant material layer) having disinfectant 146, as shown. Preferably, incompatible chemicals (such as those providing gas release, for stirring and/or entertainment purposes, when mixed) are separated from each other by impermeable layers (such as, for example, sealant 1950, as shown especially in FIG. 20) or by encapsulation. Preferably, compatible chemicals are placed together in a single layer, as shown. Upon reading the teachings of this specification, those of ordinary skill in the art will now understand that, under appropriate circumstances, such as user preference, advances in technology, intended use, etc., other ingredients, such as desiccants, preservatives, fragrances, deodorants, enzymes, fewer layers, more layers, fewer ingredients, more ingredients, dyes, multiple cleaning ingredients in one layer, abrasives, etc., may suffice.

Preferably, acid 142 (at least embodying herein wherein such at least one gas-releaser comprises at least one acid) comprises organic or inorganic acid, such as, for example, citric acid, boric acid, hydrochloric acid, hydroxyacetic acid, acetic acid, etc. Upon reading the teachings of this specification, those of ordinary skill in the art will now understand that, under appropriate circumstances, such as user preference, advances in technology, intended use, etc., other acids, such as fumaric acid, sulfuric acid, hydrogen peroxide, other acids, etc., may suffice.

Preferably, base 144 (at least embodying herein wherein such at least one gas-releaser comprises at least one alkali carbonate) comprises a carbonate, such as, for example, calcium carbonate, sodium carbonate, potassium carbonate, etc. Upon reading the teachings of this specification, those of ordinary skill in the art will now understand that, under appropriate circumstances, such as user preference, advances in technology, intended use, etc., other bases, such as, potassium hydroxide, sodium hydroxide, ammonia, etc., may suffice.

Preferably, cleanser 145 (at least embodying herein wherein such at least one cleanser comprises at least one detergent adapted to dissolve organic debris, and at least embodying herein wherein such at least one cleanser comprises at least one surfactant adapted to dislodge organic debris from such at least one plumbing fixture) comprises at least one of a surfactant, a soap, and/or a detergent, such as, for example, sodium laureth sulfate, sodium lauryl sulfate, tetrasodium pyrophosphate, anionic surfactants, wetting agents, sodium borate, tetrasodium EDTA, etc. Upon reading the teachings of this specification, those of ordinary skill in the art will now understand that, under appropriate circumstances, such as user preference, advances in technology, intended use, etc., other surfactants, soaps, and detergents, such as alkyl glucosides, ammonium lauryl sulfate, sodium stearate, dialkylmethylamines, etc., may suffice.

Preferably, disinfectant 146 disinfects the water 951 and wet plumbing fixture surfaces by killing microbes, more preferably by killing bacteria and/or viruses. Preferably, disinfectant 146 (at least embodying herein at least one disinfectant adapted to disinfect such at least one plumbing fixture) comprises at least one disinfectant such as, for example, pine oil, isopropyl alcohol, Octyl decyl dimethyl ammonium chloride, Dioctyl dimethyl ammonium chloride, Didecyl dimethyl ammonium chloride, Alkyl dimethyl benzyl ammonium chlorides, 2-butoxyethanol, bleach, thymol, eucalyptol, menthol, etc. Upon reading the teachings of this specification, those of ordinary skill in the art will now understand that, under appropriate circumstances, such as user preference, advances in technology, intended use, etc., other disinfectants, such as other alcohols, oxidizers, iodine compounds, silver compounds, phenolic compounds, quaternary ammonium compounds, etc., may suffice.

Most preferably, acid 142 comprises citric acid. Most preferably, base 144 comprises sodium bicarbonate. Preferably, when layered dispensing core 210 (at least embodying herein at least one gas-releaser adapted to release gas into at least one quantity of water contained in such at least one plumbing fixture) is dissolved in a body of water 951, acid 142 reacts in solution with base 144 to generate carbon dioxide gas 143, as shown especially in FIG. 10, which preferably releases gas bubbles and agitates the water 951 to help distribute the cleaning ingredients 120, as shown. Also, the bubbling action of the released carbon dioxide gas provides a useful and entertaining visual indicator to the user that the layered dispensing core 210 is working properly. As yet another preference, carbon dioxide gas may be dissolved in the dispensing core in well-known ways (at least embodying herein wherein such at least one gas-releaser comprises at least one gas). Upon reading the teachings of this specification, those of ordinary skill in the art will now understand that, under appropriate circumstances, such as user preference, advances in technology, intended use, etc., other gas-releasing reactions, such as other acid/carbonate reactions, reactions releasing other gasses, etc., may suffice.

Preferably, at least one of water-soluble material layer 330, coating 340, acid layer 342, base layer 344, cleanser layer 345, and disinfectant layer 346 comprise soluble colorant 348 (at least embodying herein wherein such at least one layer comprises at least one color layer adapted to provide at least one color material layer), as shown. Preferably, a sealant 1950 layer may be used to separate other layers from each other, as shown especially in FIG. 20. Preferably, soluble colorant 348 (at least embodying herein at least one color adapted to color at least one quantity of water contained in such at least one plumbing fixture) is released into the water 951 in the plumbing fixture when layered dispensing core 210 dissolves, preferably coloring (preferably blue, since there may be a pre-existing association in user's minds with cleansers) the water 951 in the plumbing fixture and providing a useful and entertaining indicator to the user that the layered dispensing core 210 is working properly. Upon reading the teachings of this specification, those of ordinary skill in the art will now understand that, under appropriate circumstances, such as user preference, advances in technology, intended use, etc., other arrangements, such as a separate color layer, multiple colors, etc., may suffice.

Preferably, coating 340 is optional. Preferably, coating 340 (at least embodying herein wherein such at least one layer comprises at least one coating layer adapted to provide at least one coating material layer) comprises at least one of a desiccant, a printing layer, a sealant 1950, a print sealer, or another material that modifies the inner and/or outer surface of layered dispensing core 210. Upon reading the teachings of this specification, those of ordinary skill in the art will now understand that, under appropriate circumstances, such as user preference, advances in technology, intended use, etc., other coatings, such as no coating, a waterproof coating, decorative coatings, etc., may suffice.

Preferably, cleaning ingredients 120 that are reasonably safe and non-toxic to humans are used.

Figure 4:
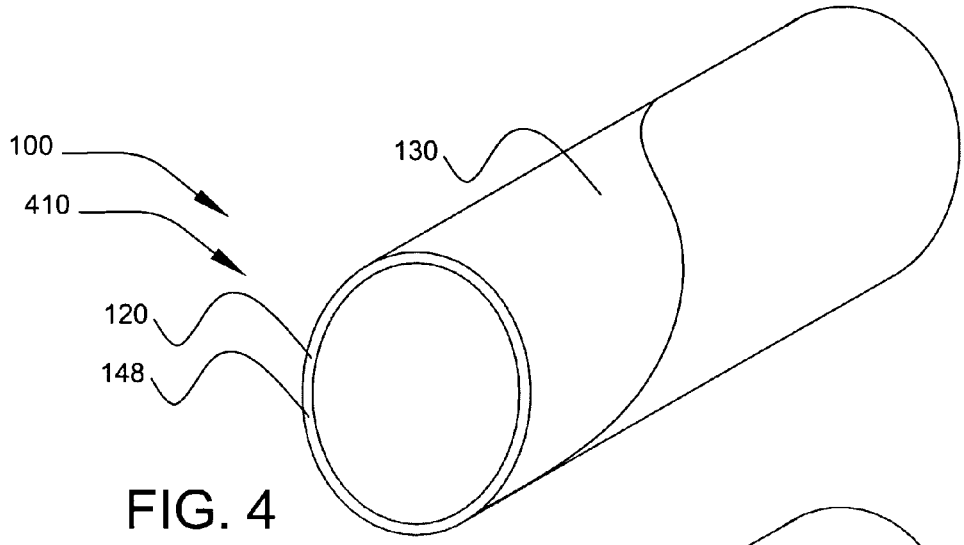
FIG. 4 shows a perspective view of a spiral dispensing core having chemicals incorporated into the paper according to a preferred embodiment of the present invention.

FIG. 4 is a perspective view of a spiral dispensing core 410 according to a preferred embodiment of the present invention. Preferably, dispensing core 110 comprises spiral dispensing core 410, as shown. Preferably, cleaning ingredients 120 and colorant 148 may be incorporated into water-soluble material 130, as shown, which is then spiral wound around a mandrel to form spiral dispensing core 410. Preferably, cleaning ingredients 120 and colorant 148 are released into the water 951 when spiral dispensing roll core 410 is placed in a wet plumbing fixture and dissolves, as shown. Upon reading the teachings of this specification, those of ordinary skill in the art will now understand that, under appropriate circumstances, such as user preference, advances in technology, intended use, etc., other arrangements, such as cleaning ingredients incorporated into the water-soluble material and also applied in layers, etc., may suffice.

Figure 5:
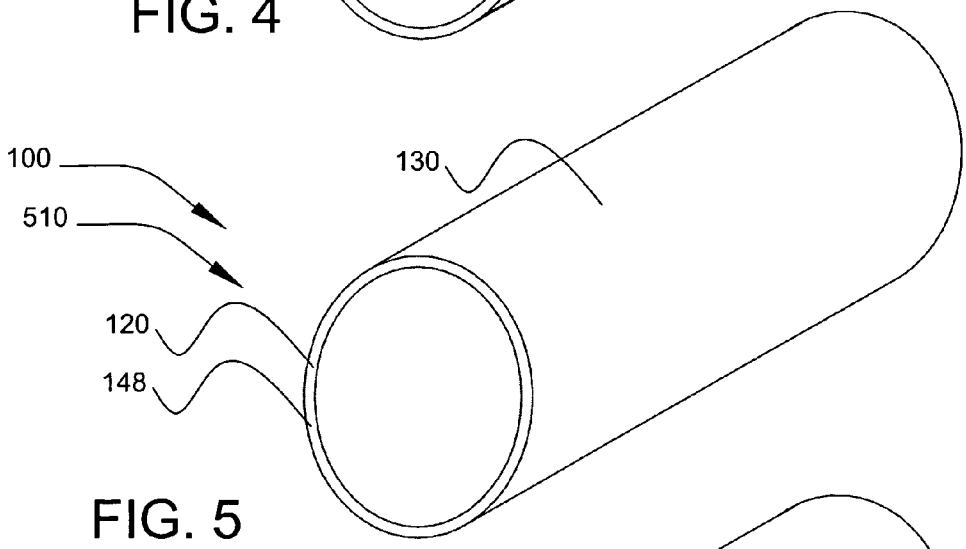
FIG. 5 shows a perspective view of a paper extruded dispensing core having chemicals incorporated into the paper according to a preferred embodiment of the present invention.
Figure 10:
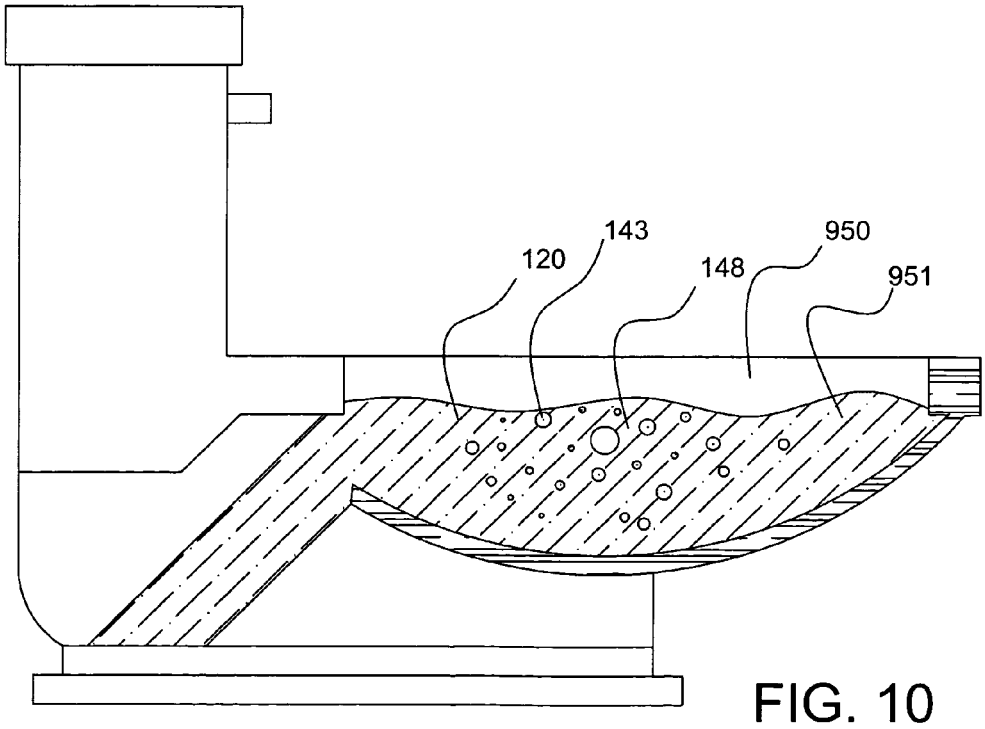
FIG. 10 shows a side view, partially in section, of the toilet bowl according to a FIG. 9, after the dispensing core has dissolved and released chemicals into the water.

FIG. 5 is a perspective view of a paper extruded dispensing core 510 having chemicals incorporated into the paper according to a preferred embodiment of the present invention. Preferably, dispensing core 110 comprises paper extruded dispensing core 510, as shown. Preferably, cleaning ingredients 120 and colorant 148 may be incorporated into the water-soluble material 130, as shown, which preferably comprises water-soluble paper pulp, which is then extruded (in manners well-known in the extrusion art) to form paper extruded dispensing core 510 (at least embodying herein wherein such soluble paper-roll core means comprises unitary bulk means for providing bulk unitary material for such soluble paper-roll core means, and at least embodying herein wherein such at least one soluble paper-roll core comprises at least one unitary bulk adapted to provide at least one bulk unitary material for such at least one soluble paper-roll core). Preferably, cleaning ingredients 120 and colorant 148 are released into the water 951 when paper extruded dispensing core 510 is placed in a wet plumbing fixture and dissolves, as shown in FIG. 10. Upon reading the teachings of this specification, those of ordinary skill in the art will now understand that, under appropriate circumstances, such as user preference, advances in technology, intended use, etc., other arrangements, such as cleaning ingredients incorporated into the water-soluble material and also applied in layers, etc., may suffice.

Figure 6:
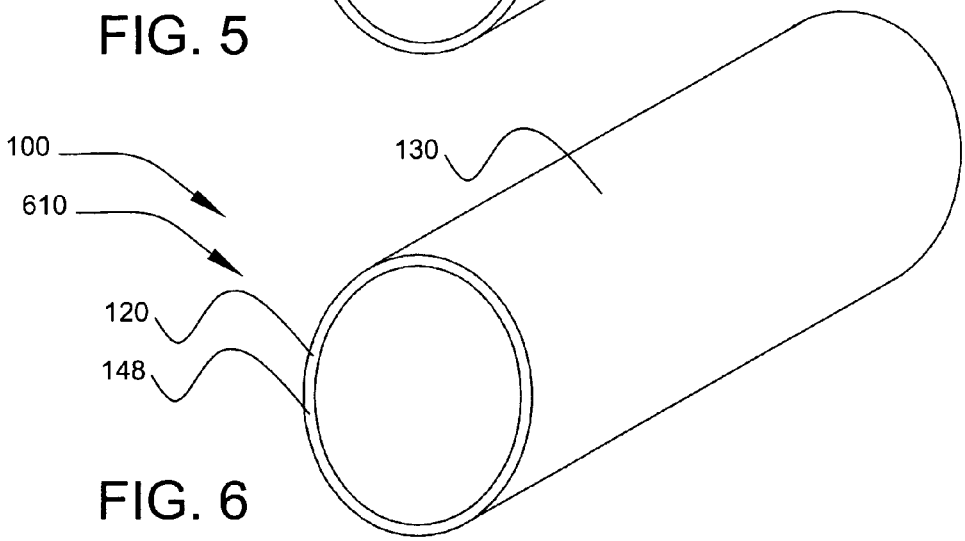
FIG. 6 shows a perspective view of a plastic extruded dispensing core having chemicals incorporated into the plastic according to a preferred embodiment of the present invention.

FIG. 6 is a perspective view of a plastic extruded dispensing core 610 having chemicals incorporated into the plastic according to a preferred embodiment of the present invention. Preferably, dispensing core 110 comprises plastic or polymer extruded dispensing core 610, as shown. Preferably, cleaning ingredients 120 and colorant 148 may be incorporated into the water-soluble material 130, as shown, which preferably comprises at least one liquid water-soluble polymer, which is then extruded and cured to form plastic extruded dispensing core 610 (at least embodying herein wherein such soluble paper-roll core means comprises plastic means for providing plastic material for such soluble paper-roll core means, and at least embodying herein wherein such at least one soluble paper-roll core comprises at least one plastic adapted to provide at least one plastic material for such at least one soluble paper-roll core), as shown. Preferably, cleaning ingredients 120 and colorant 148 are released into the water 951 when plastic extruded dispensing core 610 is placed in a wet plumbing fixture and dissolves, as shown in FIG. 10. Upon reading the teachings of this specification, those of ordinary skill in the art will now understand that, under appropriate circumstances such as user preference, advances in technology, intended use, etc., other arrangements, such as cleaning ingredients incorporated into the water-soluble material and also applied in layers, etc., may suffice.

Figure 7A:
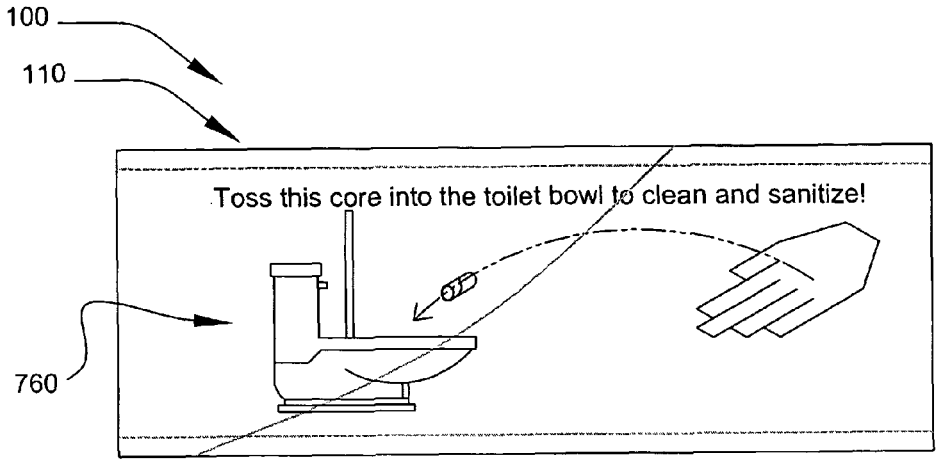
FIG. 7A shows a side plan view of a dispensing core with instructional indicia according to a preferred embodiment of the present invention.
Figure 8:
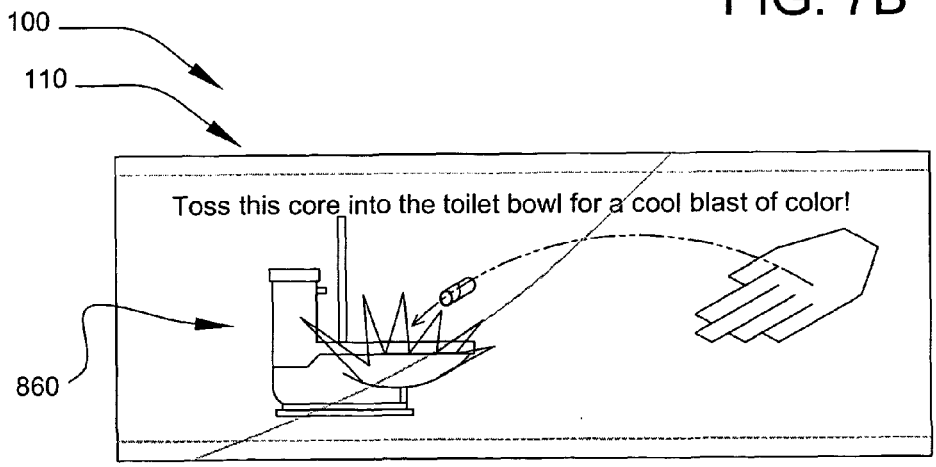
FIG. 8 shows a side plan view of a dispensing core with entertaining indicia according to a preferred embodiment of the present invention.

FIG. 7A is a side plan view of a dispensing core 110 with instructional indicia 760 according to a preferred embodiment of the present invention. Preferably, instructional indicia 760 instructs users in how to use dispensing core 110 for cleaning and sanitizing purposes, as shown. Preferably, instructional indicia 760 (at least embodying herein at least one instructional indicia adapted to visually instruct at least one user) are visible when paper roll 105 is removed from dispensing core 110, as shown. Example indicia, as shown in FIG. 7A and FIG. 8, might include the pictures and words illustrated in the drawings, e.g., "Toss this core into the toilet bowl to clean and sanitize!"; "Toss this core into the toilet bowl for a cool blast of color!". Upon reading the teachings of this specification, those of ordinary skill in the art will now understand that, under appropriate circumstances, such as user preference, advances in technology, intended use, etc., other indicia, such as other instructions, other graphics, etc., may suffice.

Figure 7B:
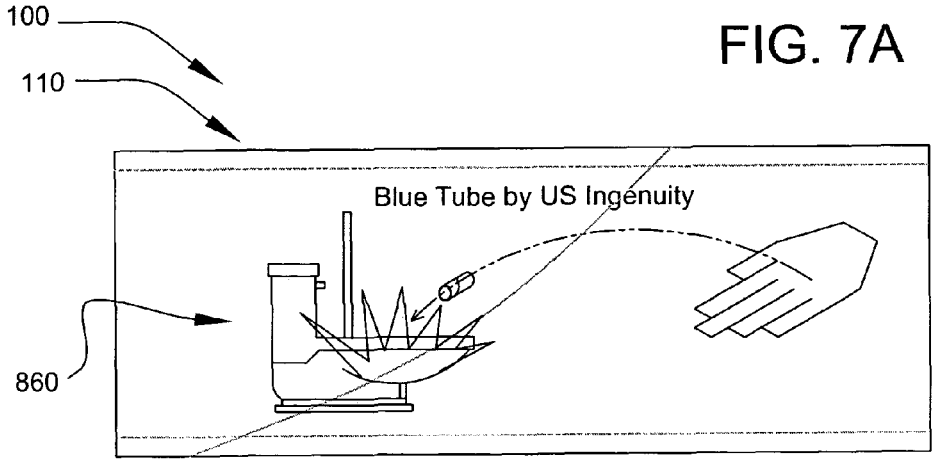
FIG. 7B shows the dispensing core of FIG. 7A with an alternative preferred instructional indicia.

FIG. 7B shows the dispensing core 110 of FIG. 7A with an alternative preferred instructional indicia 760. Example indicia might include the pictures and words illustrated in the drawing indicating the brand and manufacturer of dispensing core 110, e.g., "Blue Tube by US Ingenuity".

FIG. 8 is a side plan view of a dispensing core 110 with entertaining indicia 860 according to a preferred embodiment of the present invention. Preferably, entertaining indicia 860 instructs users, particularly children, in how to use dispensing core 110 for entertainment purposes, as shown, (although, importantly, the cleaning and sanitizing functions are still present and are still performed). Preferably, entertaining indicia 860 (at least embodying herein at least one entertainment indicia adapted to visually entertain at least one user) is visible when paper roll 105 is removed from dispensing core 110, as shown. Upon reading the teachings of this specification, those of ordinary skill in the art will now understand that, under appropriate circumstances, such as user preference, advances in technology, intended use, etc., other indicia, such as other instructions, other graphics, comics, characters, etc., may suffice.

Figure 9:
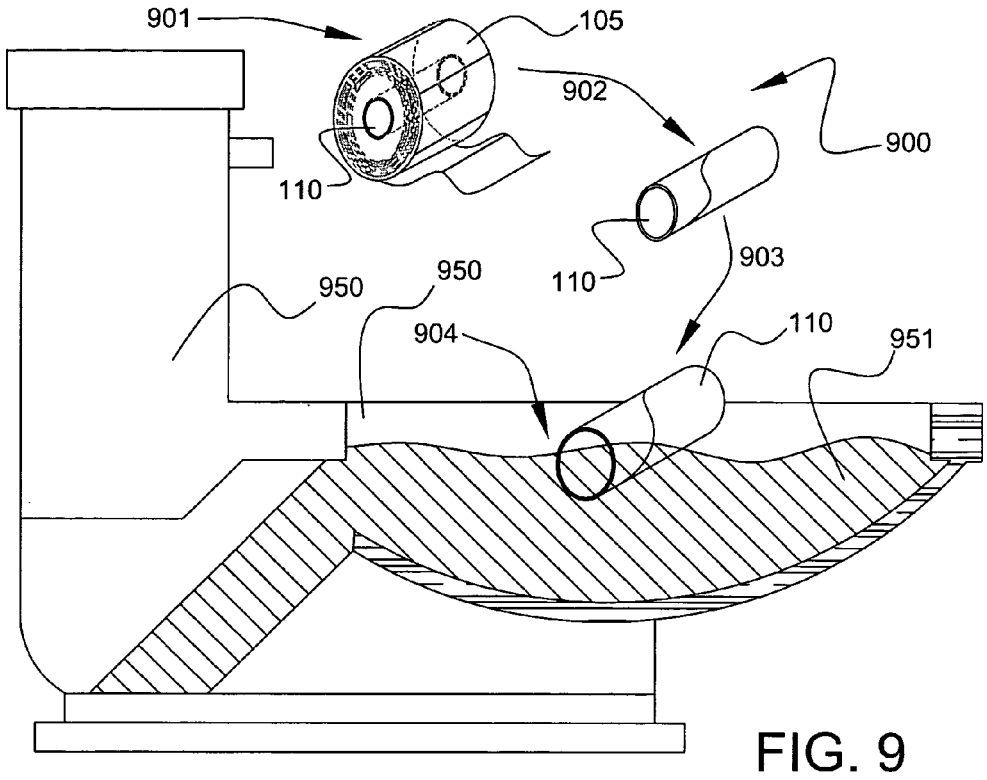
FIG. 9 shows a side view, partially in section, of a dispensing core being put into a toilet bowl according to a preferred embodiment of the present invention.

FIG. 9 is a side view, partially in section, of a dispensing core 110 being put into a toilet bowl 950 (at least embodying herein wherein such at least one plumbing fixture comprises at least one toilet bowl) according to a preferred embodiment of the present invention. Preferably, dispensing paper-roll core system 100 comprises method 900 comprising the steps of: acquiring 901 a paper roll 105 having a dispensing core 110 (at least embodying herein acquiring at least one paper-roll having at least one cleanser-releasing soluble core); removing 902 substantially all paper from the paper roll 105 (at least embodying herein removing substantially all paper from such at least one paper-roll); placing 903 the dispensing core 110 in a plumbing fixture (at least embodying herein placing such at least one cleanser-releasing soluble core in at least one plumbing fixture); and wetting 904 the dispensing core 110 (at least embodying herein wetting such at least one cleanser-releasing soluble core), as shown. FIG. 9 shows dispensing core 110 at approximately the moment it hits the water 951. Upon reading the teachings of this specification, those of ordinary skill in the art will now understand that, under appropriate circumstances, such as user preference, advances in technology, intended use, etc., other steps, such as reading instructional indicia, waiting a certain amount of time before flushing, removing less than all of the paper from the dispensing core, etc., may suffice.

FIG. 10 is a side view, partially in section, of the toilet bowl 950 according to a FIG. 9, after dispensing core 110 has dissolved and released cleaning ingredients 120 and colorant 148 into the water 951. Preferably, dispensing core 110 dissolves and releases cleaning ingredients 120 and colorant 148 into the water 951, as shown, preferably within one minute of wetting, more preferably within thirty seconds of wetting, most preferably within ten seconds of wetting. Preferably, the user does not rinse away or flush the water 951 for a period of time sufficient to permit cleaning chemicals 120 to clean and sanitize at least one portion of toilet bowl 950, preferably at least about five minutes, more preferably at least about three minutes, most preferably at least about one minute. Upon reading the teachings of this specification, those of ordinary skill in the art will now understand that, under appropriate circumstances, such as user preference, advances in technology, intended use, etc., other steps, such as flushing prior to using the dispensing roll, using a scrub brush on the toilet bowl, waiting overnight, waiting for a color change, etc., may suffice.

Figure 11:
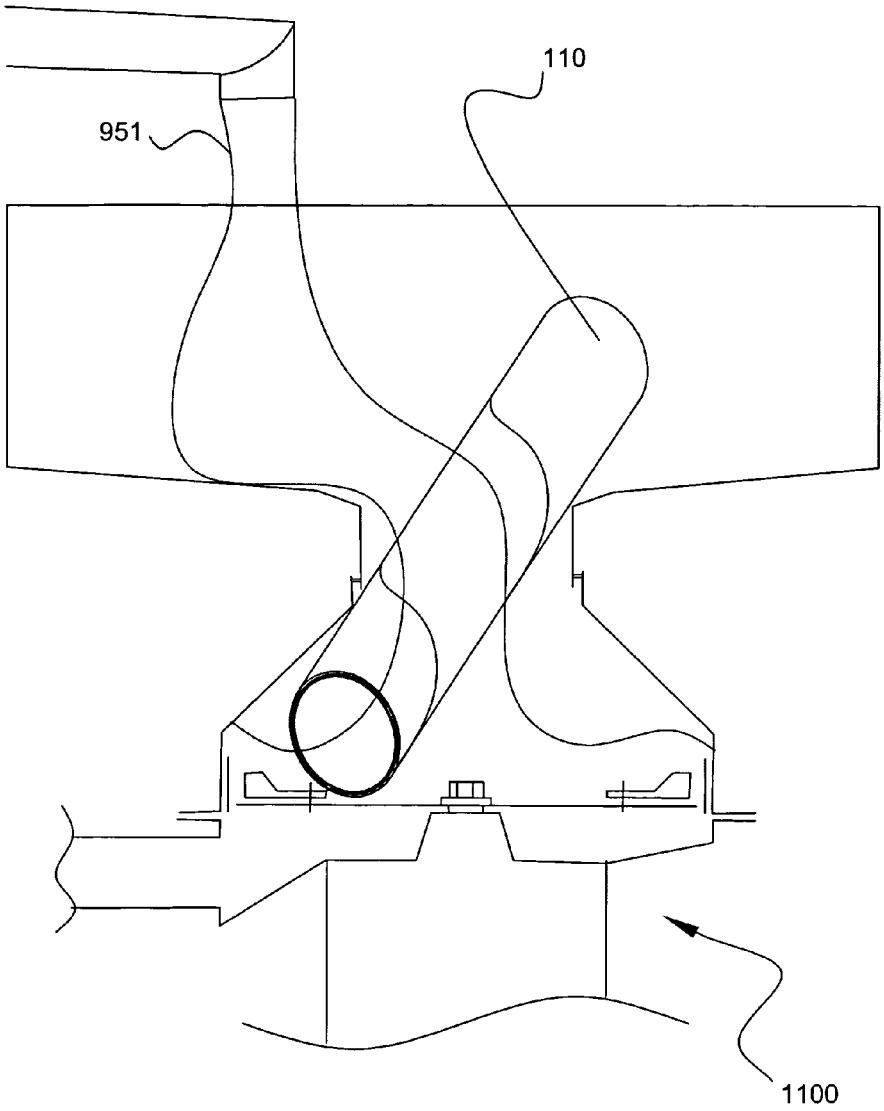
FIG. 11 shows a side view, partially in section, of a dispensing core being used in a garbage disposal according to a preferred embodiment of the present invention.

FIG. 11 is a side view, partially in section, of a dispensing core 110 being used in a garbage disposal 1100 (at least embodying herein wherein such at least one plumbing fixture comprises at least one garbage disposal) according to a preferred embodiment of the present invention. Preferably, dispensing core 110 may be wetted and dissolved before (as shown), during, or after activating the garbage disposal 1100. Upon reading the teachings of this specification, those of ordinary skill in the art will now understand that, under appropriate circumstances, such as user preference, advances in technology, intended use, etc., other steps, such as adding abrasive material to the garbage disposal to assist cleansing action, etc., may suffice.

Figure 12:
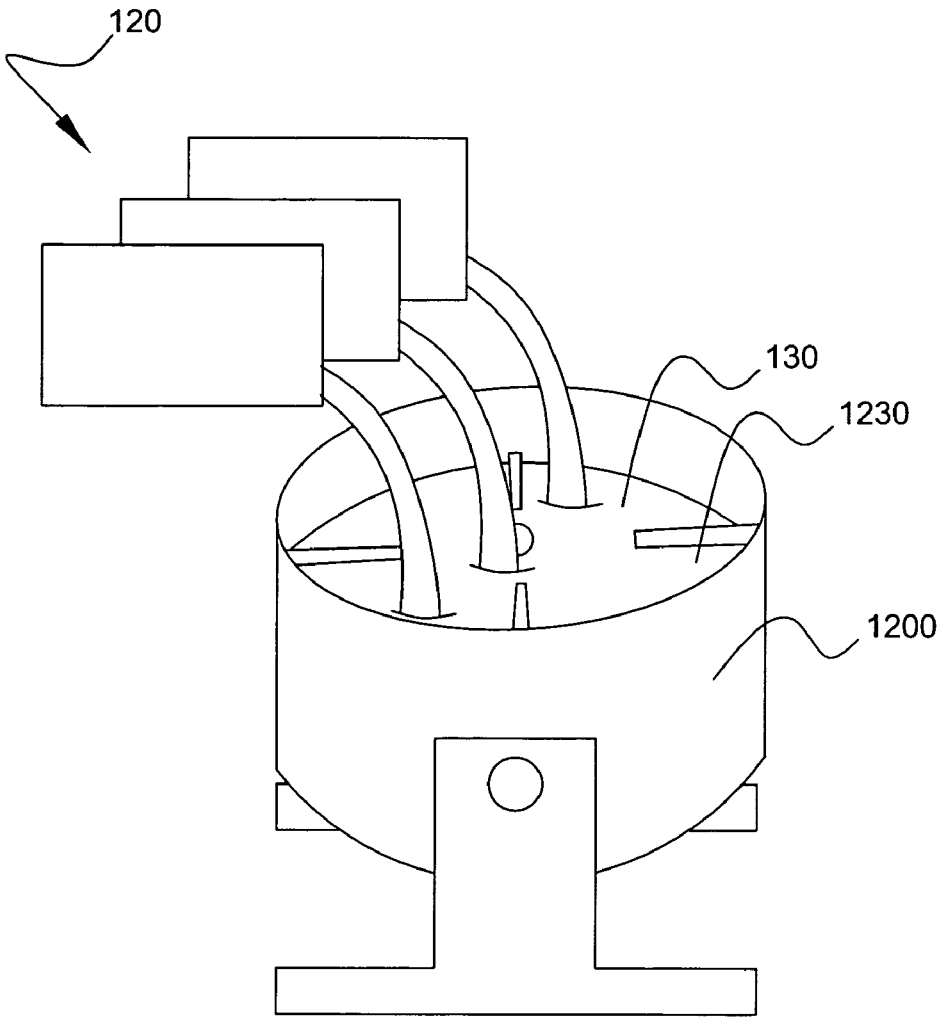
FIG. 12 shows a perspective view of a batch vat having chemicals added to it according to a preferred embodiment of the present invention.

FIG. 12 is a perspective view of a batch vat 1200 having cleaning chemicals 120 added to it according to a preferred embodiment of the present invention. Preferably, for spiral dispensing core 410, paper extruded dispensing core 510, and plastic extruded dispensing core 610, cleaning chemicals 120 and colorant 148 are mixed into the bulk support material 130 before support material 130 is shaped or formed, as shown.

Preferably, solvent 1230 is also added to bulk support material 130, as shown, to help liquefy the batch for ease of processing. Preferably, solvent 1230 is a solvent for one or more of the other ingredients, and is substantially non-reactive with the other ingredients. Preferably, after support material 130 is shaped or formed, solvent 1230 is evaporated away. Preferably, solvent 1230 comprises a solvent such as, for example, isopropyl alcohol, ethylated alcohol, ethanol, denatured alcohol, etc. Upon reading the teachings of this specification, those with ordinary skill in the art will now understand that, under appropriate circumstances, considering such issues as advances in technology, user preference, chemical compatibility, etc., other solvents, such as water, organic solvents, ethylene glycol, ethers, etc., may suffice.

Preferably, chemicals 120 may be added in forms such as, for example, bulk chemicals, encapsulated chemicals, liquid, etc., as appropriate. For example, where citric acid and sodium bicarbonate are being added to a batch of support material 130 such as, for example, water-soluble paper pulp, the sodium bicarbonate and citric acid may each be separately encapsulated in water-soluble polymer particles that only dissolve in low-ionic strength water, so that the sodium bicarbonate and citric acid will not react with each other or the paper pulp during manufacturing, and will be released into the plumbing water to react with each other. Upon reading the teachings of this specification, those of ordinary skill in the art will now understand that, under appropriate circumstances, such as user preference, advances in technology, intended use, etc., other processes, such as suffusing the support material with chemicals after shaping, etc., may suffice.

Figure 13:
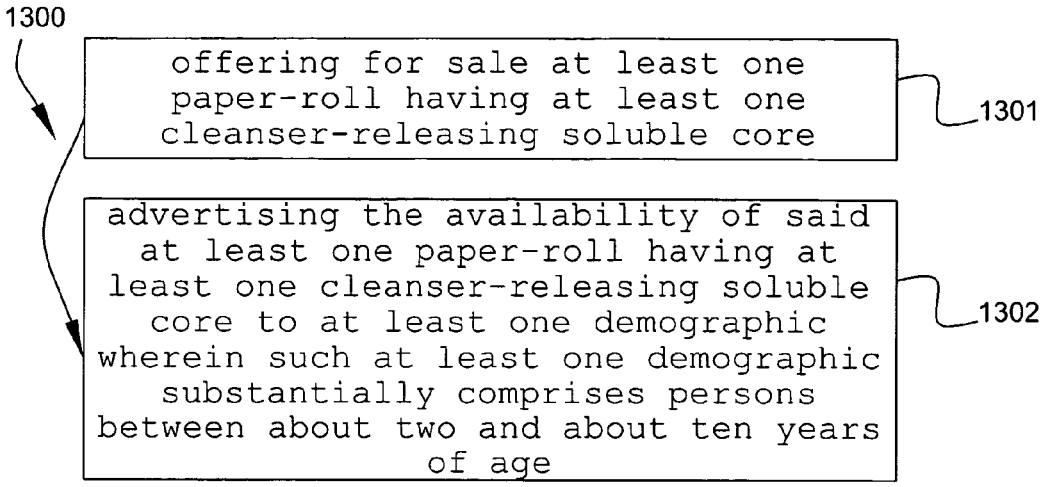
FIG. 13 shows a flow diagram of a method according to a preferred embodiment of the present invention.

FIG. 13 is a flow diagram of method 1300 according to a preferred embodiment of the present invention. Preferably, the useful and entertaining nature of the present invention makes it especially suitable for use by children, especially during toilet training. Preferably, dispensing paper-roll core system 100 comprises method 1300 comprising the steps of: offering 1301 for sale at least one paper roll 105 having at least one cleanser-releasing soluble core 110 (at least embodying herein offering for sale at least one paper-roll having at least one cleanser-releasing soluble core); and advertising 1302 the availability of such at least one paper roll 105 having at least one cleanser-releasing soluble core 110 to at least one demographic (at least embodying herein advertising the availability of such at least one paper-roll having such at least one cleanser-releasing soluble core to at least one demographic) wherein such at least one demographic substantially comprises persons between about two and about ten years of age (at least embodying herein wherein such at least one demographic substantially comprises persons between about two and about ten years of age), as shown. Upon reading the teachings of this specification, those of ordinary skill in the art will now understand that, under appropriate circumstances, such as user preference, advances in technology, intended use, etc., other steps, such as advertising during children's television programs, providing small specialty toilet paper-rolls, providing single-use toilet paper-rolls, placing child-targeted indicia on the paper-roll, etc., may suffice.

Figure 14:
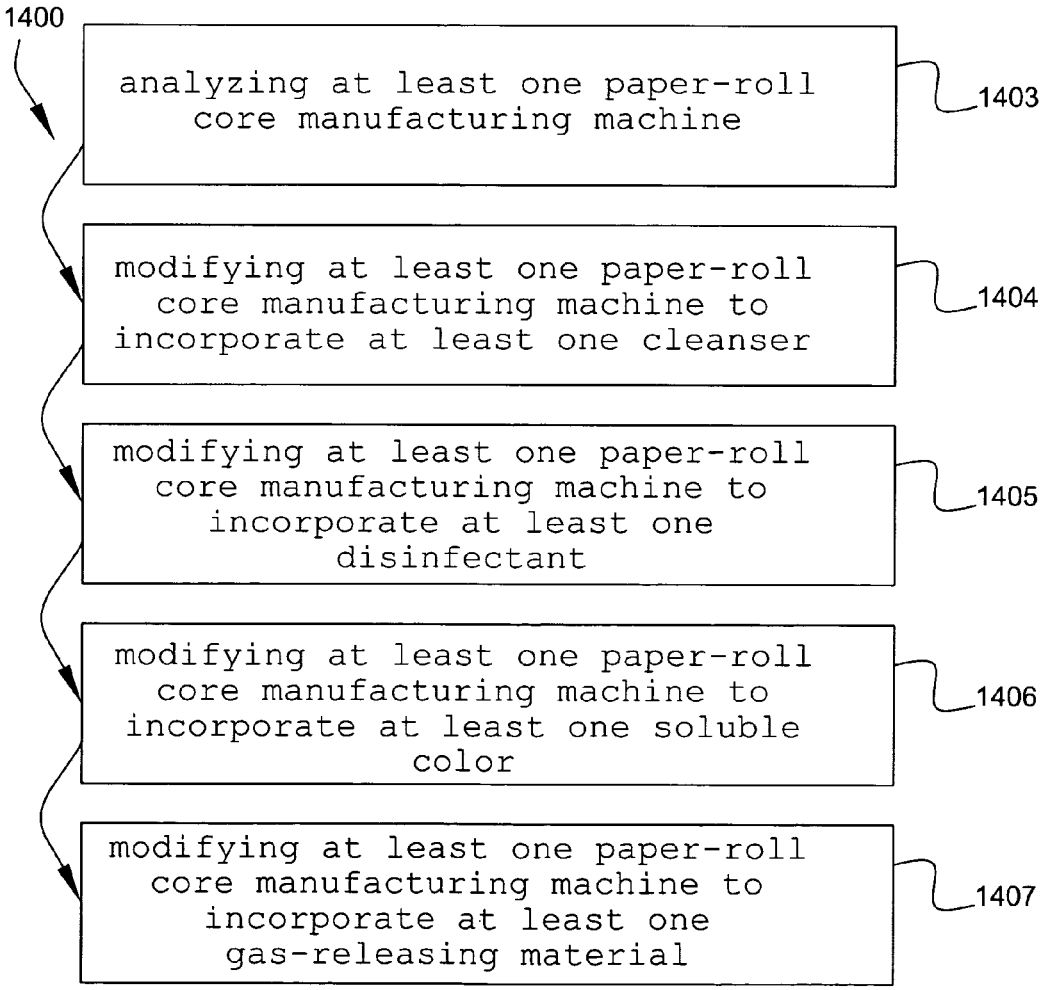
FIG. 14 shows a flow diagram of a method according to a preferred embodiment of the present invention.

FIG. 14 is a flow diagram of method 1400 according to a preferred embodiment of the present invention. Preferably, dispensing paper-roll core systems 100 are manufactured with conventional industrial core-making machines with a minimal addition, or no addition, of modified parts. Preferably, conventional industrial core-making machines and processes may be analyzed and then modified to produce dispensing paper-roll core systems 100.

Preferably, dispensing paper-roll core system 100 comprises method 1400 comprising the steps of: analyzing 1403 (at least embodying herein analyzing at least one paper-roll core manufacturing machine) at least one paper-roll core manufacturing machine; modifying 1404 (at least embodying herein modifying at least one paper-roll core manufacturing machine to incorporate at least one cleanser into such at least one paper-roll core) at least one paper-roll core manufacturing machine to incorporate at least one cleanser into such at least one paper-roll core wherein such steps of analyzing 1403 and modifying 1404 are economically advantageous over the cost of replacing such at least one paper-roll core manufacturing machine (at least embodying herein wherein such steps of analyzing and modifying are economically advantageous over the cost of replacing such at least one paper-roll core manufacturing machine), as shown.

Preferably, method 1400 further comprises at least one of the steps of: modifying 1405 (at least embodying herein the step of modifying at least one paper-roll core manufacturing machine to incorporate at least one disinfectant into such at least one paper-roll core) at least one paper-roll core manufacturing machine to incorporate at least one disinfectant into such at least one paper-roll core; modifying 1406 (at least embodying herein the step of modifying at least one paper-roll core manufacturing machine to incorporate at least one soluble color into such at least one paper-roll core) at least one paper-roll core manufacturing machine to incorporate at least one soluble color into such at least one paper-roll core; and/or modifying 1407 (at least embodying herein the step of modifying at least one paper-roll core manufacturing machine to incorporate at least one gas-releasing material into such at least one paper-roll core) at least one paper-roll core manufacturing machine to incorporate at least one gas-releasing material into such at least one paper-roll core, as shown. Upon reading the teachings of this specification, those of ordinary skill in the art will now understand that, under appropriate circumstances, such as user preference, advances in technology, intended use, etc., other steps, such as selling modified manufacturing machines, selling modular add-on equipment for the conversions, providing economic analyses of conversion costs, etc., may suffice.

Figure 15:
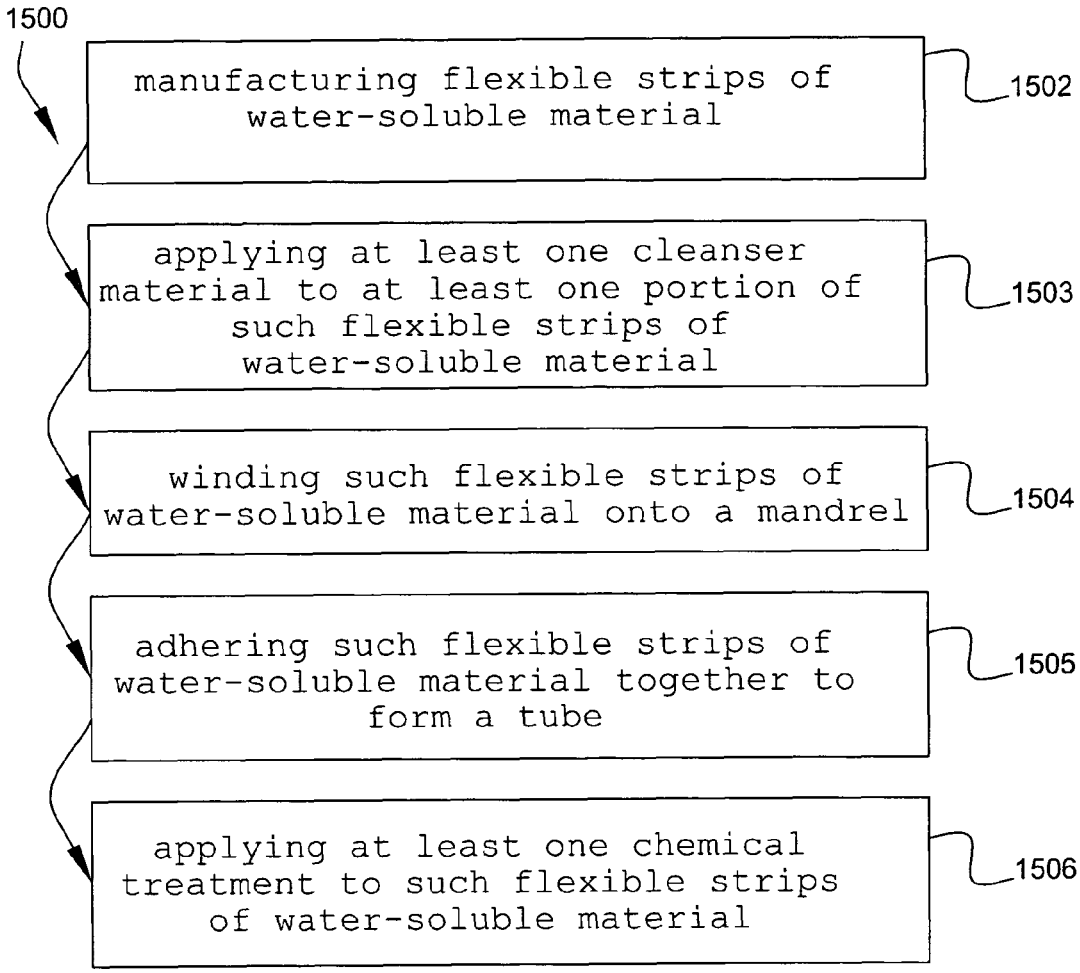
FIG. 15 shows a flow diagram of a method according to a preferred embodiment of the present invention.

FIG. 15 is a flow diagram of method 1500 according to a preferred embodiment of the present invention. Preferably, dispensing paper-roll core system 100 comprises method 1500 for manufacturing layered dispensing cores 210, comprising the steps of: manufacturing 1502 (at least embodying herein manufacturing flexible strips of water-soluble material) flexible strips of water-soluble material 130; applying 1503 (at least embodying herein applying at least one cleanser material to at least one portion of such flexible strips of water-soluble material) at least one cleanser material 120 to at least one portion of such flexible strips of water-soluble material 130; winding 1504 (at least embodying herein winding such flexible strips of water-soluble material onto a mandrel) such flexible strips of water-soluble material 130 onto a mandrel; and adhering 1505 (at least embodying herein adhering such flexible strips of water-soluble material together to form a tube) such flexible strips of water-soluble material 130 together to form a tube. Preferably, method 1500 further comprises the step of applying 1506 (at least embodying herein the step of applying at least one chemical treatment to such flexible strips of water-soluble material) at least one chemical treatment to such flexible strips of water-soluble material 130 (such as, for example, the acid 142, a base 144, a cleanser 145, colorant 148, and/or a disinfectant 146 previously discussed), as shown. This method is further illustrated in FIGS. 17-20. Upon reading the teachings of this specification, those of ordinary skill in the art will now understand that, under appropriate circumstances, such as user preference, advances in technology, intended use, economic factors, etc., other steps, such as applying other chemicals and/or materials, manufacturing flexible strips of water-soluble material already containing cleanser and/or other chemicals, purchasing strips of water-soluble material, cutting lengths of the tube, winding paper onto the tube, etc., may suffice.

Figure 16:
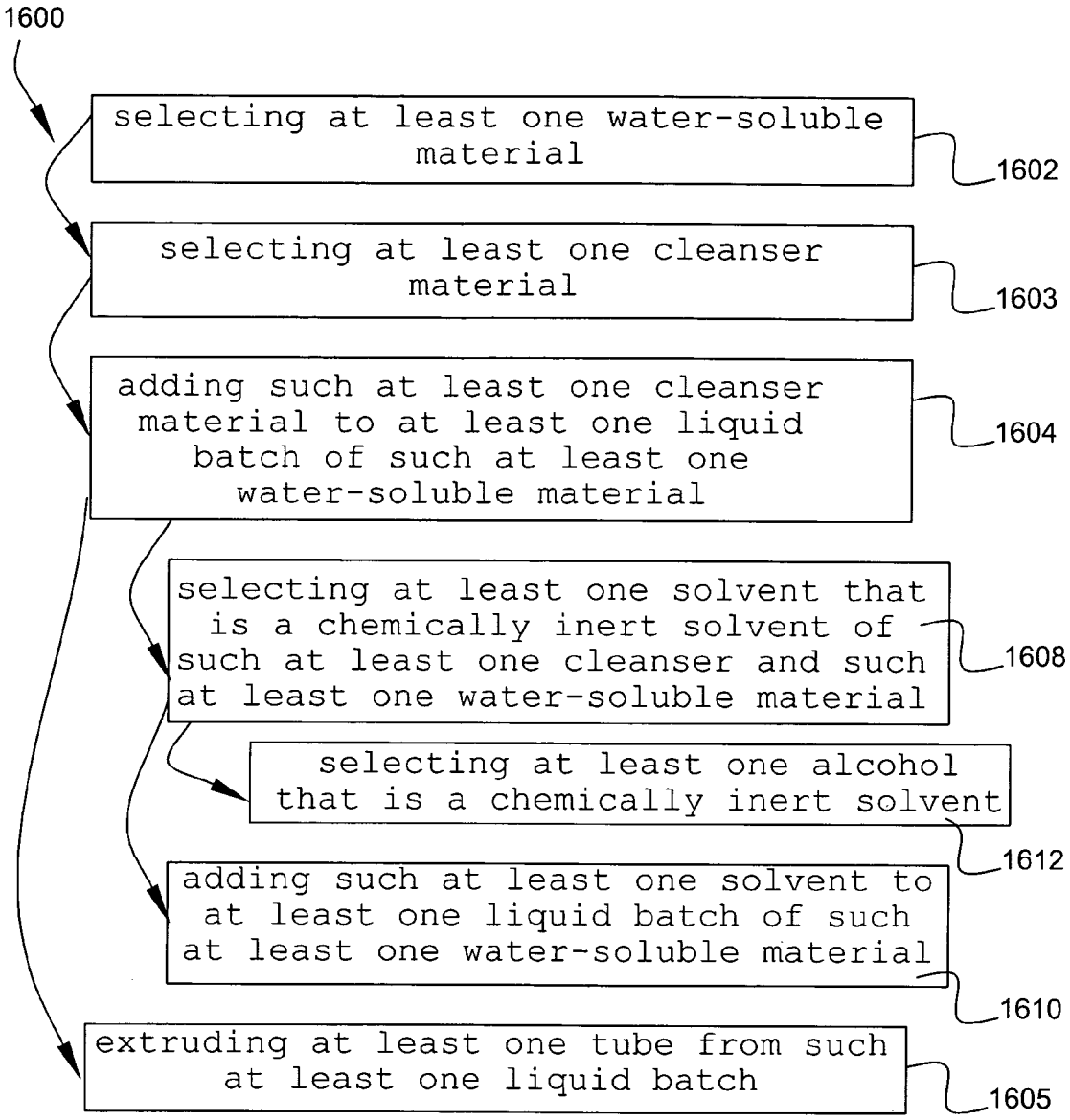
FIG. 16 shows a flow diagram of a method according to a preferred embodiment of the present invention.

FIG. 16 is a flow diagram of method 1600 according to a preferred embodiment of the present invention. Preferably, dispensing paper-roll core system 100 comprises method 1600 for manufacturing paper extruded dispensing cores 510 and/or plastic extruded dispensing cores 610, comprising the steps of: selecting 1602 (at least embodying herein selecting at least one water-soluble material) at least one water-soluble material 130; selecting 1603 (at least embodying herein selecting at least one cleanser material) at least one cleanser material 120; adding 1604 (at least embodying herein adding such at least one cleanser material to at least one liquid batch of such at least one water-soluble material) such at least one cleanser material 120 to at least one liquid batch of such at least one water-soluble material 130; and extruding 1605 (at least embodying herein extruding at least one tube from such at least one liquid batch) at least one tube from such at least one liquid batch, as shown. Upon reading the teachings of this specification, those of ordinary skill in the art will now understand that, under appropriate circumstances, such as user preference, advances in technology, intended use, economic factors, etc., other steps, such as adding other chemicals and/or materials to the batch, cutting lengths of the tube, winding paper onto the tube, etc., may suffice.

Preferably, method 1600 further comprises the steps of selecting (step 1608) at least one solvent 1230 that is a chemically inert solvent of such at least one cleanser material 120 and such at least one water-soluble material 130; and adding (step 1610) such at least one solvent 1230 to at least one liquid batch of such at least one water-soluble material 130 (at least embodying herein selecting at least one solvent that is a chemically inert solvent of such at least one cleanser and such at least one water-soluble material; and adding such at least one solvent to at least one liquid batch of such at least one water-soluble material; and at least embodying herein wherein the step of selecting at least one solvent comprises the step of selecting at least one alcohol that is a chemically inert solvent of such at least one cleanser and such at least one water-soluble material).

Preferably, where solvent 1230 is used, the step of selecting (step 1608) at least one solvent 1230 that is a chemically inert solvent of such at least one cleanser material 120 and such at least one water-soluble material 130 further comprises the step of selecting (step 1612) at least one alcohol that is a chemically inert solvent of cleanser material 120 and water-soluble material 130, as shown.

Figure 17:
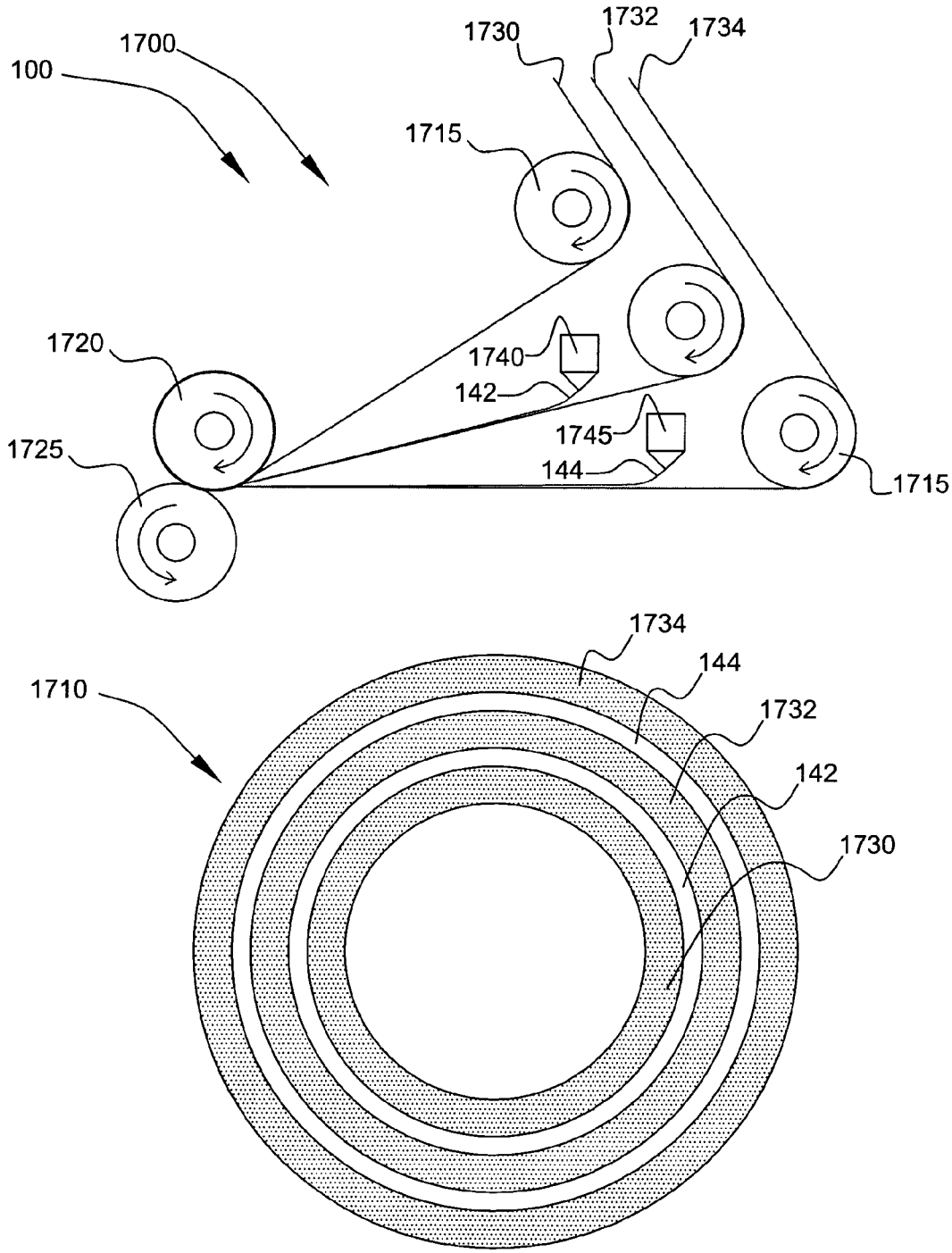
FIG. 17 shows a diagram of a winder according to a preferred embodiment of the present invention.

FIG. 17 is a flow diagram of winder 1700 according to a preferred embodiment of the present invention. Preferably, dispensing paper-roll core system 100 comprises winder 1700 for manufacturing layered dispensing cores 210, as shown. Preferably, three rollers 1715 guide three strips 1730, 1732, and 1734 of water-soluble material 130 toward mandrel 1720 and presser roller 1725, as shown. Preferably, dispenser 1740 applies acid 142, such as, for example, citric acid, to a strip 1732, as shown. Preferably, dispenser 1745 applies base 144, such as, for example, sodium bicarbonate, to another strip 1734, as shown. This serves to separate acid 142 from base 144 prior to dissolution. The resulting layered dispensing core 1710 is shown in cross-section. Upon reading the teachings of this specification, those with ordinary skill in the art will now understand that, under appropriate circumstances, considering such issues as advances in technology, user preference, etc., other arrangements, such as other layer orders, other roller placements, other cleaning chemicals, etc., may suffice.

Figure 18:
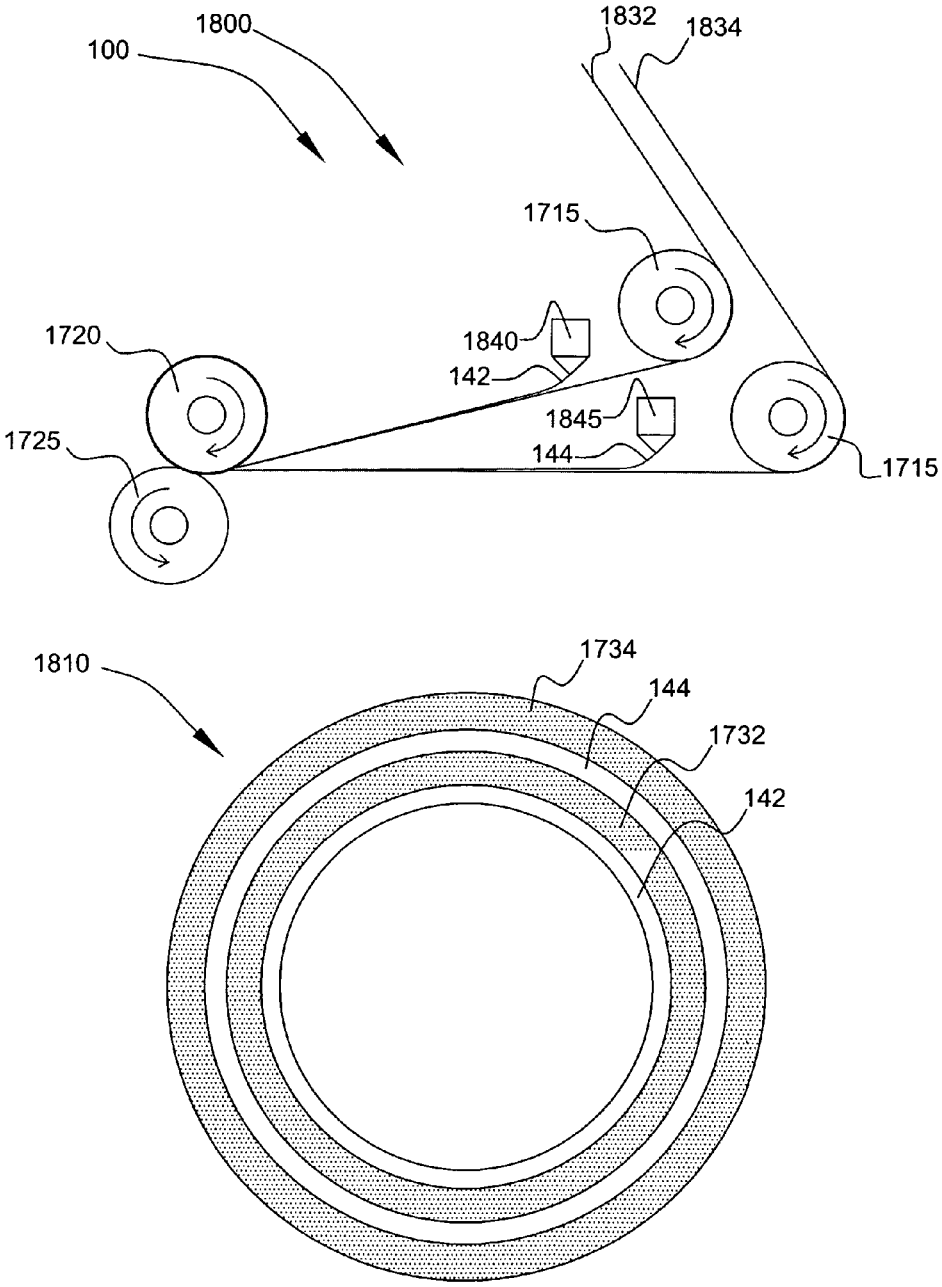
FIG. 18 shows a diagram of a winder according to a preferred embodiment of the present invention.

FIG. 18 is a diagram of winder 1800 according to a preferred embodiment of the present invention. Preferably, dispensing paper-roll core system 100 comprises winder 1800 for manufacturing layered dispensing cores 210, as shown. Preferably, two rollers 1715 guide two strips 1832 and 1834 of water-soluble material 130 toward mandrel 1720 and presser roller 1725, as shown. Preferably, dispenser 1840 applies acid 142, such as, for example, citric acid, to a strip 1832, as shown. Preferably, dispenser 1845 applies base 144, such as, for example, sodium bicarbonate, to another strip 1834, as shown. This serves to separate acid 142 from base 144 prior to dissolution. The resulting layered dispensing core 1810 is shown in cross-section. Upon reading the teachings of this specification, those with ordinary skill in the art will now understand that, under appropriate circumstances, considering such issues as advances in technology, user preference, etc., other arrangements, such as other layer orders, other roller placements, other cleaning chemicals, etc., may suffice.

Figure 19:
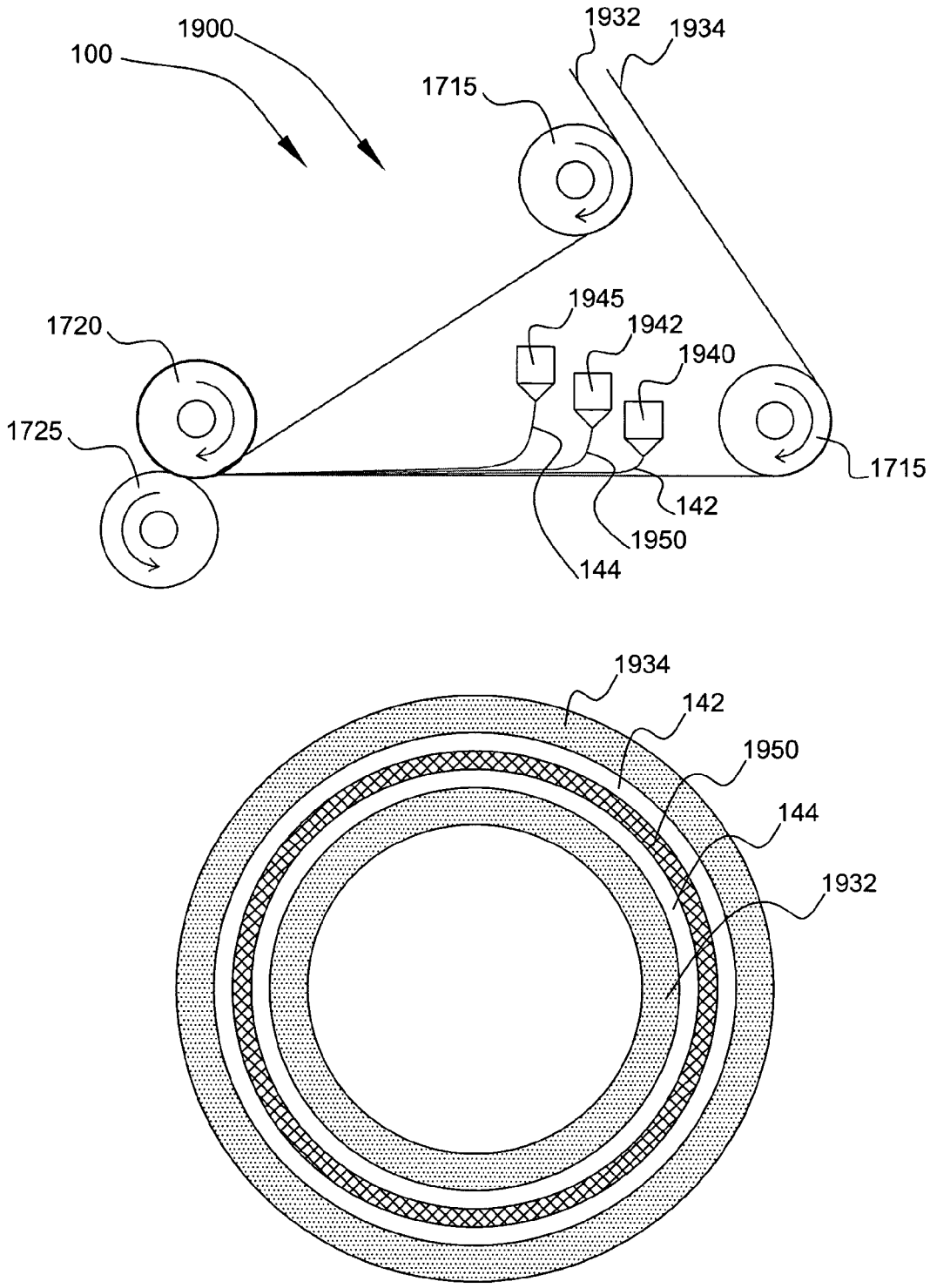
FIG. 19 shows a diagram of a winder according to a preferred embodiment of the present invention.

FIG. 19 is a diagram of a winder 1900 according to a preferred embodiment of the present invention. Preferably, dispensing paper-roll core system 100 comprises winder 1900 for manufacturing layered dispensing cores 210, as shown. Preferably, two rollers 1715 guide two strips 1932 and 1934 of water-soluble material 130 toward mandrel 1720 and presser roller 1725, as shown. Preferably, dispenser 1940 applies acid 142, such as, for example, citric acid, to strip 1932, as shown. Preferably, dispenser 1942 applies sealant 1950 over acid 142, as shown. Preferably, dispenser 1945 applies base 144, such as, for example, sodium bicarbonate, to strip 1932 over sealant 1950, as shown. Sealant 1950 serves to separate acid 142 from base 144 prior to dissolution. The resulting layered dispensing core 1910 is shown in cross-section. Upon reading the teachings of this specification, those with ordinary skill in the art will now understand that, under appropriate circumstances, considering such issues as advances in technology, user preference, etc., other arrangements, such as other layer orders, other roller placements, other cleaning chemicals, etc., may suffice.

Preferably, sealant 1950 comprises water-soluble material, such as, for example, polyvinyl alcohol, starch, sugars, polyethylene glycol, etc. Upon reading the teachings of this specification, those with ordinary skill in the art will now understand that, under appropriate circumstances, considering such issues as advances in technology, user preference, chemical compatibility, etc., other water-soluble sealants, such as water-soluble film, water-soluble paper, mineral oil, etc., may suffice.

Figure 20:
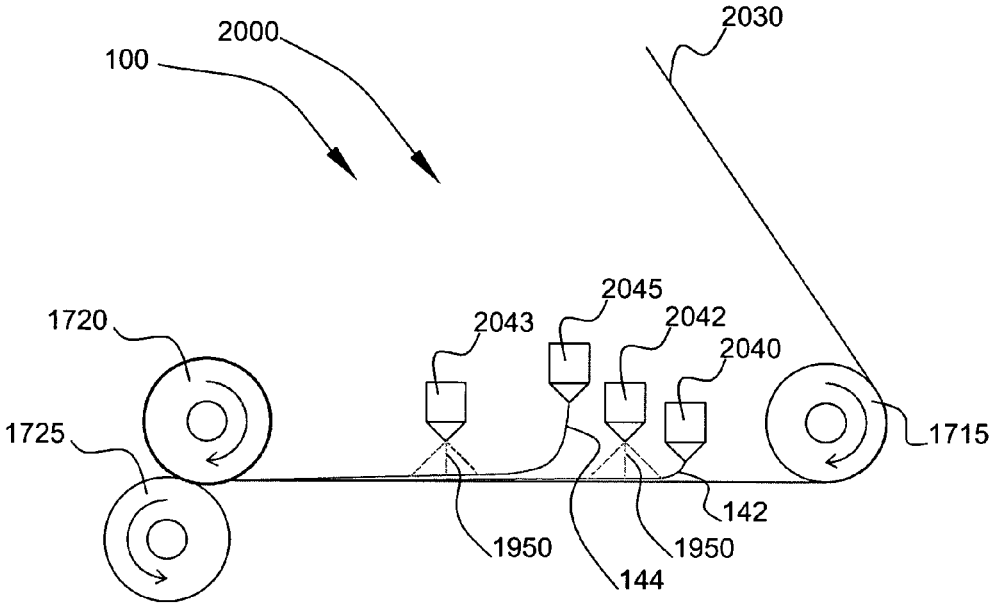
FIG. 20 shows a diagram of a winder according to a preferred embodiment of the present invention.
Figure 20:
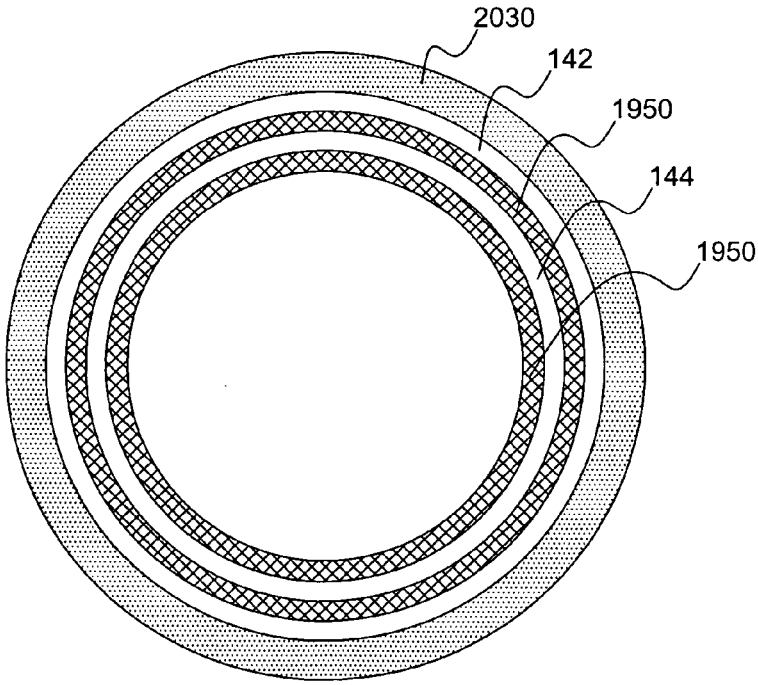

FIG. 20 is a diagram of a winder 2000 according to a preferred embodiment of the present invention. Preferably, dispensing paper-roll core system 100 comprises winder 2000 for manufacturing layered dispensing cores 210, as shown. Preferably, two rollers 1715 guide strip 2030 of water-soluble material 130 toward mandrel 1720 and presser roller 1725, as shown. Preferably, dispenser 2040 applies acid 142, such as, for example, citric acid, to strip 2030, as shown. Preferably, dispenser 2042 applies sealant 1950 over acid 142, as shown. Preferably, dispenser 2045 applies base 144, such as, for example, sodium bicarbonate, to strip 2030 over sealant 1950, as shown. Preferably, dispenser 2043 applies sealant 1950 over base 144, as shown. Sealant 1950 serves to separate acid 142 from base 144 prior to dissolution, and to protect base 144 from direct contact with the air. The resulting layered dispensing core 2010 is shown in cross-section. Upon reading the teachings of this specification, those with ordinary skill in the art will now understand that, under appropriate circumstances, considering such issues as advances in technology, user preference, chemical compatibility, etc., other water-soluble sealants, such as water-soluble film, water-soluble paper, mineral oil, etc., may suffice.

Figure 21:
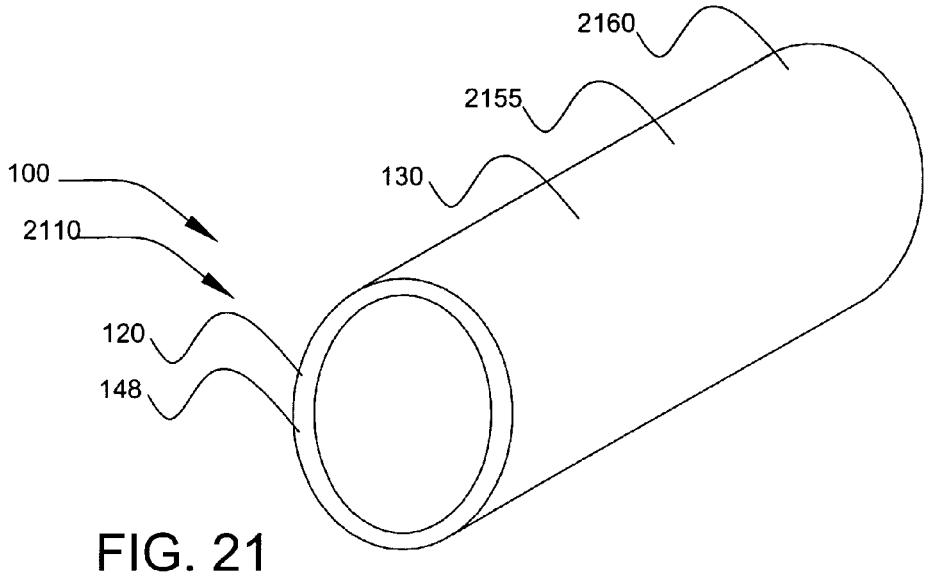
FIG. 21 shows a perspective view of a compressed powder dispensing core having chemicals compressed into a solid tube shape according to a preferred embodiment of the present invention.

FIG. 21 is a perspective view of a compressed powder dispensing core 2110 having chemicals compressed into a solid tube shape according to a preferred embodiment of the present invention. Preferably, dispensing core 2110 comprises cleaning ingredients 120, as shown. Preferably, dispensing core 2110 comprises binder 2155, as shown. Preferably, dispensing core 2110 comprises lubricant 2160, as shown. Preferably, dispensing core 2110 comprises colorant 148, as shown.

Preferably, binder 2155 (at least embodying herein wherein such at least one soluble paper-roll core comprises at least one binder to bind the ingredients of such at least one soluble paper-roll core together) comprises a material capable of adhering other materials together into a solid mass under compression, such as, for example, polyethylene glycol, sorbitol, maltodextrin, other sugars, pectin, etc. Preferably, binder 2155 is used as needed with any dispensing core 110 composition and/or manufacturing process. Upon reading the teachings of this specification, those with ordinary skill in the art will now understand that, under appropriate circumstances, considering such issues as advances in technology, user preference, chemical compatibility, etc., other binders, such as water, alcohol, starch, polymers, cellulose, etc., may suffice.

Preferably, lubricant 2160 (at least embodying herein wherein such at least one soluble paper-roll core comprises at least one lubricant to lubricate the ingredients of such at least one soluble paper-roll core during manufacturing processes) comprises a material capable of lubricating the flow of the powdered product through the compression equipment, such as, for example, sodium benzoate, stearates, polyethylene glycol, mineral oil, silicates, alginic acid, etc. Preferably, lubricant 2160 is used as needed with any dispensing core 110 composition and/or manufacturing process. Upon reading the teachings of this specification, those with ordinary skill in the art will now understand that, under appropriate circumstances, considering such issues as advances in technology, user preference, chemical compatibility, etc., other lubricants, such as vegetable oil, glycerin, fats, metal stearates, etc., may suffice.

Preferably, cleaning ingredients 120, lubricant 2160, and binder 2155, and optionally colorant 148, are mixed together as dry powders, and are then compressed in a die into the shape of a tube. This manufacturing method is described for tablet-shaped objects in U.S. Pat. No. 6,713,441 B1, herein incorporated in its entirety by reference. Upon reading the teachings of this specification, those with ordinary skill in the art will now understand that, under appropriate circumstances, considering such issues as advances in technology, user preference, chemical compatibility, etc., other arrangements, such as other ingredients, using a moist powder, etc., may suffice.

In an alternative preferred embodiment, cleaning ingredients 120, particularly acid 142 and base 144, are layered into microspheres, which are then compressed in a die into the shape of a tube. This manufacturing method is described for tablet-shaped objects in U.S. Pat. No. 6,210,711 B1, herein incorporated in its entirety by reference. Upon reading the teachings of this specification, those with ordinary skill in the art will now understand that, under appropriate circumstances, considering such issues as advances in technology, user preference, chemical compatibility, etc., other arrangements, such as other ingredients, using a moist powder, etc., may suffice.

Preferably, cleaning ingredients 120 and colorant 148 are released into the water 951 when compressed powder dispensing core 2110 is placed in a wet plumbing fixture and dissolves, as shown in FIG. 10.

Figure 22A:
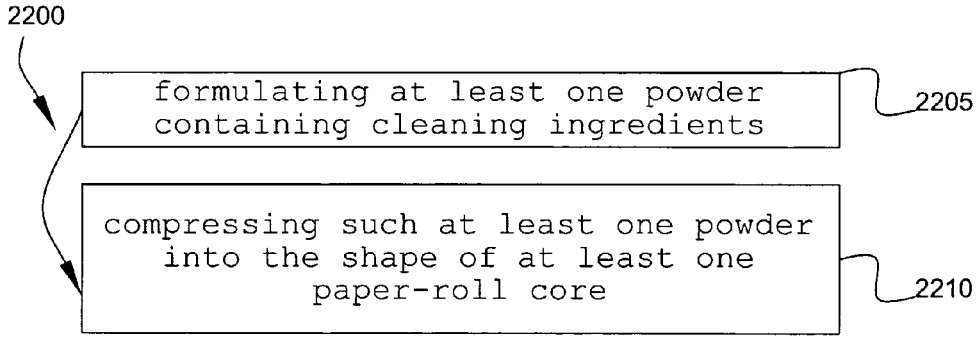
FIG. 22A shows a flow diagram of a method according to a preferred embodiment of the present invention.

FIG. 22A is a diagram of method 2200 according to a preferred embodiment of the present invention. Preferably, dispensing paper-roll core system 100 comprises method 2200 for manufacturing compressed powder dispensing cores 2110, as shown. Preferably, method 2200 comprises the steps of: formulating (step 2205) at least one powder comprising cleaning ingredients 120; and compressing (step 2220) such at least one powder into the shape of at least one paper-roll core (at least embodying herein formulating at least one powder comprising at least one cleanser; and compressing such at least one powder into the shape of at least one paper-roll core), as shown.

Figure 22B:
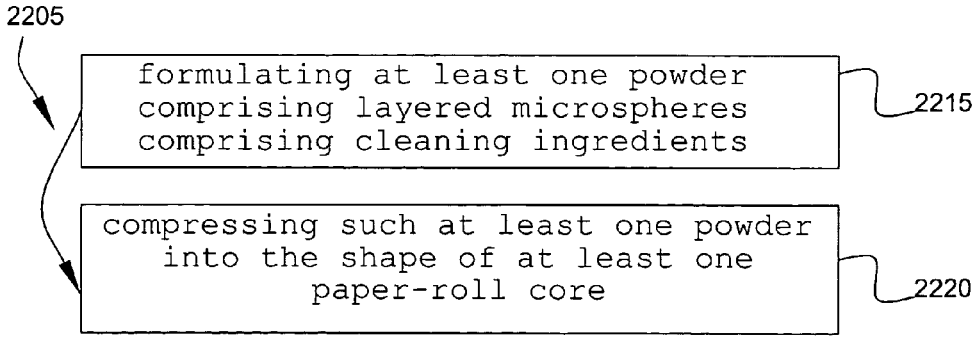
FIG. 22B shows a flow diagram of a method according to a preferred embodiment of the present invention.

FIG. 22B is a diagram of method 2205 according to a preferred embodiment of the present invention. Preferably, dispensing paper-roll core system 100 comprises method 2205 for manufacturing compressed powder dispensing cores 2110, as shown. Preferably, method 2205 comprises the steps of: formulating (step 2215) at least one powder comprising layered microspheres comprising cleaning ingredients 120; and compressing (step 2220) such at least one powder into the shape of at least one paper-roll core (at least embodying herein formulating at least one powder comprising layered microspheres comprising at least one cleanser; and compressing such at least one powder into the shape of at least one paper-roll core), as shown.

Figure 23A:
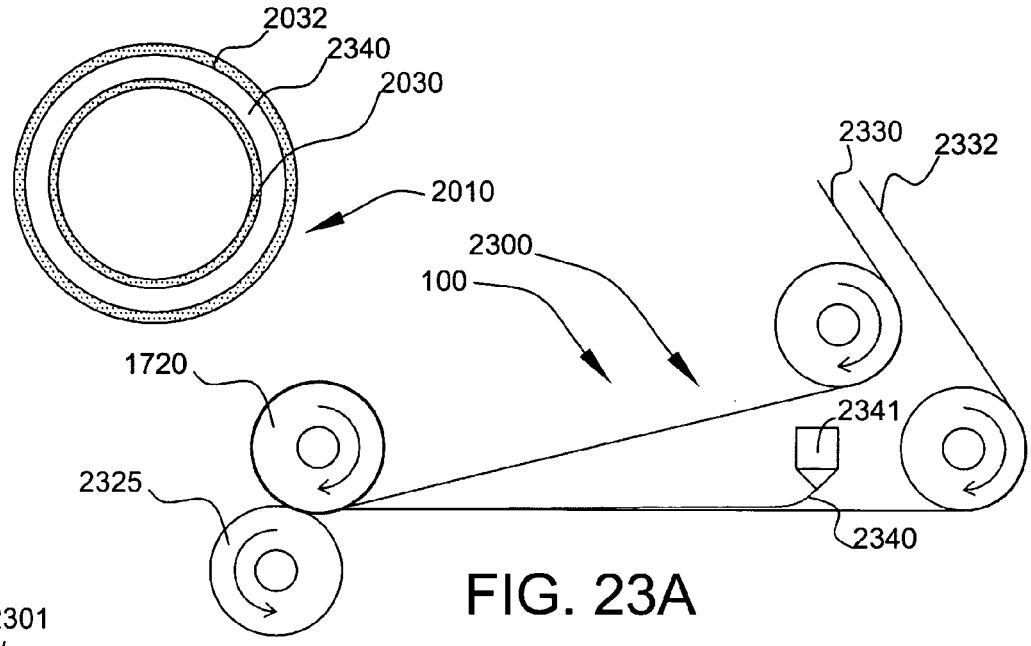
FIG. 23A shows a diagram of a winder according to a preferred embodiment of the present invention.
Figure 23B:
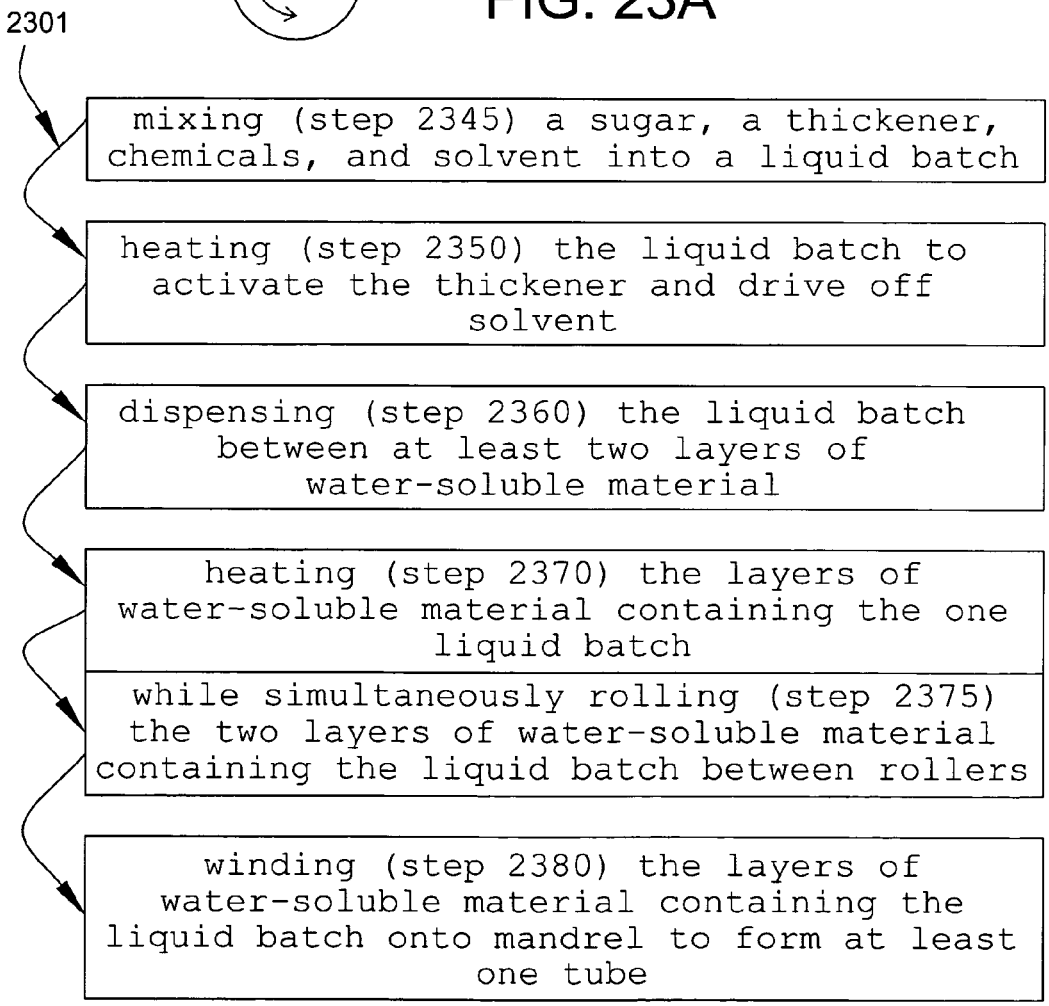
FIG. 23B shows a flow diagram of a method according to a preferred embodiment of the present invention.

FIG. 23A shows a diagram of winder 2300 and and FIG. 23B shows a flow diagram of method 2301 according to a preferred embodiment of the present invention.

Preferably, dispensing paper-roll core system 100 comprises winder 2300 for manufacturing layered dispensing cores 2310, as shown. Preferably, chemicals 120 may be mixed with alcohol, sugar, and pectin in vat 1200; then, the mixture is heated to drive off the alcohol and form an alcohol-free gel 2340 containing chemicals 120, as shown. Gel 2340 is then placed between two water-soluble material strips 2330 and 2332 using dispenser 2341, which are then rolled between mandrel 1720 and heated presser roller 2325 to set gel 2340 into a soft, pliable material adhered to and sandwiched between strips 2330 and 2332, as shown. Strips 2330 and 2332 are then wound around mandrel 1720 to form layered dispensing core 2310, as shown. The resulting layered dispensing core 2310 is shown in cross-section.

Preferably, dispensing paper-roll core system 100 comprises method 2301 for manufacturing layered dispensing cores 2310, as shown. Preferably, method 2301 comprises the steps of: mixing (step 2345) a sugar, a thickener, chemicals 120, and solvent 1230 into a liquid batch; heating (step 2350) the liquid batch to activate the thickener and drive off solvent 1230; dispensing (step 2360) the liquid batch between at least two layers of water-soluble material 130; simultaneously heating (step 2370) the layers of water-soluble material 130 containing the one liquid batch, while rolling (step 2375) the two layers of water-soluble material 130 containing the liquid batch between rollers 2325; and winding (step 2380) the layers of water-soluble material 130 containing the liquid batch onto mandrel 1720 to form at least one tube (at least embodying herein the steps of mixing at least one sugar, at least one thickener, at least one cleanser, and at least one solvent into at least one liquid batch; heating such at least one liquid batch to activate such at least one thickener and drive off such at least one solvent; dispensing such at least one liquid batch between at least two layers of at least one water-soluble material; simultaneously heating such at least two layers of at least one water-soluble material containing such at least one liquid batch, and rolling such at least two layers of at least one water-soluble material containing such at least one liquid batch between at least two rollers; and winding such at least two layers of at least one water-soluble material containing such at least one liquid batch onto at least one mandrel to form at least one tube), as shown.

Upon reading the teachings of this specification, those with ordinary skill in the art will now understand that, under appropriate circumstances, considering such issues as advances in technology, user preference, chemical compatibility, etc., other arrangements, such as other chemicals, other thickeners (such as corn starch, pectin activated by monocalcium phosphate, etc.), additional layers, additional heated rollers, etc., may suffice.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A core system, relating to dispensing roll(s) of paper and capable of cleaning and/or disinfecting a plumbing fixture, comprising:

a) at least one soluble paper-roll core that comprises a rapidly-dissolving water-soluble support material and is a hollow support core around which a paper-roll may be wound;

b) at least one cleanser comprising a surfactant, a soap, and/or a detergent, said cleanser being adapted to clean at least one plumbing fixture; and c) at least one gas-releaser comprising at least one acid and at least one base, said gas-releaser being adapted to release gas into at least one quantity of water contained in said at least one plumbing fixture;

wherein said at least one soluble paper-roll core comprises said at least one cleanser and said at least one gas-releaser that are released into the water when said at least one paper-roll core dissolves.

2. The core system, according to claim 1, wherein said at least one soluble paper-roll comprises at least one toilet paper-roll.

3. The core system, according to claim 1, wherein said at least one soluble paper-roll comprises at least one paper towel roll.

4. The core system, according to claim 1, wherein said at least one soluble paper-roll core comprises at least one unitary bulk adapted to provide at least one bulk unitary material for said at least one soluble paper-roll core.

5. The core system, according to claim 1, wherein said at least one soluble paper-roll core comprises at least one layer adapted to provide at least one layering of said at least one soluble paper-roll core.

6. The core system, according to claim 5, wherein said at least one layer comprises a plurality of layers adapted to provide a plurality of layers of at least one water-soluble material.

7. The core system, according to claim 1, wherein said at least one soluble paper-roll core comprises at least one plastic adapted to provide at least one plastic material for said at least one soluble paper-roll core.

8. The core system, according to claim 1, further comprising:

a) at least one paper-roll core adapted to provide at least one such roll of paper; and b) at least one connector adapted to connect said at least one paper roll about said at least one soluble paper-roll core.

9. The core system, according to claim 8, wherein said at least one connector is water-soluble.

10. The core system, according to claim 8, wherein said at least one connector comprises at least one color additive adapted to provide at least one color to water upon dissolving.

11. The core system, according to claim 8, wherein said at least one connector comprises at least one cleanser adapted to provide at least one cleanser to water upon dissolving.

12. The core system, according to claim 8, wherein said at least one connector comprises at least one disinfectant additive adapted to provide at least one disinfectant to water upon dissolving.

13. The core system, according to claim 1, wherein said at least one cleanser comprises at least one detergent adapted to dissolve organic debris.

14. The core system, according to claim 1, wherein said at least one soluble paper-roll core comprises at least one disinfectant adapted to provide at least one disinfectant to water upon dissolving.

15. The core system, according to claim 1, wherein said at least one soluble paper-roll core comprises at least one water-soluble coating layer adapted to provide at least one water-soluble coating material layer.

16. The core system, according to claim 1, wherein said at least one soluble paper-roll core comprises at least one color additive adapted to provide at least one color to water upon dissolving.

17. The core system, according to claim 1, wherein said at least one paper-roll core comprises at least one binder to bind the ingredients of said at least one soluble paper-roll core together.

18. The core system, according to claim 17, wherein said at least one binder comprises at least one sugar.

19. The core system, according to claim 17, wherein said at least one binder comprises polyethylene glycol.

20. The core system, according to claim 17, wherein said at least one binder comprises sorbitol.

21. The core system, according to claim 17, wherein said at least one binder comprises maltodextrin.

22. The core system, according to claim 17, wherein said at least one binder comprises at least one pectin.

23. The core system, according to claim 1, wherein said at least one soluble paper-roll core comprises at least one lubricant to lubricate the ingredients of said at least one soluble paper-roll core during manufacturing processes.

24. The core system, according to claim 23, wherein said at least one lubricant comprises sodium benzoate.

25. The core system, according to claim 23, wherein said at least one lubricant comprises at least one stearate.

26. The core system, according to claim 23, wherein said at least one lubricant comprises polyethylene glycol.

27. The core system, according to claim 23, wherein said at least one lubricant comprises at least one mineral oil.

28. The core system, according to claim 23, wherein said at least one lubricant comprises at least one silicate.

29. The core system, according to claim 23, wherein said at least one lubricant comprises algenic acid.

30. The core system, according to claim 1, wherein said at least one soluble paper-roll core further comprising at least one instructional indicia adapted to visually instruct at least one user.

31. The core system, according to claim 1, wherein said at least one soluble paper-roll core further comprising at least one entertainment indicia adapted to visually entertain at least one user.

32. The core system, according to claim 1, further comprising such at least one roll of paper.

33. The core system, according to claim 1, wherein said at least one soluble paper-roll core comprises at least one water-soluble coating layer adapted to provide at least one water-soluble coating material layer.

34. The core system, according to claim 1, wherein the cleanser is selected from the group consisting of sodium laureth sulfate, sodium lauryl sulfate, tetrasodium pyrophosphate, anionic surfactants, wetting agents, sodium borate, tetrasodium EDTA, soaps, alkyl glucosides, ammonium lauryl sulfate, sodium stearate, dialkylmethylamines, and combinations thereof.

35. The core system, according to claim 1, wherein the acid is selected from the group consisting of citric acid, boric acid, hydrochloric acid, hydroxyacetic acid, acetic acid, fumaric acid, sulfuric acid, hydrogen peroxide, and combinations thereof.

36. The core system, according to claim 35, wherein the acid is citric acid.

37. The core system, according to claim 1, wherein the base is selected from the group consisting of calcium carbonate, sodium carbonate, potassium carbonate, potassium hydroxide, sodium hydroxide, ammonia, and combinations thereof.

38. The core system, according to claim 37, wherein the base is sodium bicarbonate.

39. The core system, according to claim 14, wherein the disinfectant is selected from the group consisting of pine oil, isopropyl alcohol, Octyl decyl dimethyl ammonium chloride, Dioctyl dimethyl ammonium chloride, Didecyl dimethyl ammonium chloride, Alkyl dimethyl benzyl ammonium chlorides, 2-butoxyethanol, bleach, thymol, eucalyptol, menthol, alcohols, oxidizers, iodine compounds, silver compounds, phenolic compounds, quaternary ammonium compounds, and combinations thereof.

* * * * *